US011559116B2

(12) United States Patent
Miyazaki et al.

(10) Patent No.: US 11,559,116 B2
(45) Date of Patent: Jan. 24, 2023

(54) SLIDER FOR SLIDE FASTENER

(71) Applicant: YKK Corporation, Tokyo (JP)

(72) Inventors: Yohei Miyazaki, Kurobe (JP); Koji Yamagishi, Kurobe (JP); Yoshikazu Hamada, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/312,373

(22) PCT Filed: Dec. 20, 2018

(86) PCT No.: PCT/JP2018/047047
§ 371 (c)(1),
(2) Date: Jun. 9, 2021

(87) PCT Pub. No.: WO2020/129217
PCT Pub. Date: Jun. 25, 2020

(65) Prior Publication Data

US 2022/0015512 A1 Jan. 20, 2022

(51) Int. Cl.
*A44B 19/30* (2006.01)

(52) U.S. Cl.
CPC ..... *A44B 19/30* (2013.01)

(58) Field of Classification Search
CPC ... A44B 19/305; A44B 19/306; A44B 19/308; A44B 19/266; Y10T 24/262; Y10T 24/2598; Y10T 24/2566
See application file for complete search history.

(56) References Cited

U.S. PATENT DOCUMENTS 2,233,661 A * 3/1941 Bugg ..... A44B 19/262 70/68
2,666,969 A * 1/1954 Morin ..... A44B 19/308 24/424

(Continued)

FOREIGN PATENT DOCUMENTS

CN 102972932 B 3/2013
CN 105231602 A 1/2016

(Continued)

OTHER PUBLICATIONS

Office Action with Search Report, Taiwanese Patent Application No. 108117824, dated Apr. 27, 2020.

(Continued)

*Primary Examiner* — Robert Sandy
(74) *Attorney, Agent, or Firm* — Kilpatrick Townsend & Stockton LLP

(57) ABSTRACT

A slider includes a slider body part that includes an upper wing plate and a lower wing plate, a stop tab body, a tab elastic member that biases the stop tab body, a base part integrally formed with the upper wing plate, and an operation cover part rotatably attached to the base part. The operation cover part includes a pressing projecting part that projects from an inner surface of a top plate part, and the pressing projecting part has a configuration in which by rotating the operation cover part, a locked state and an unlocked state can be switched therebetween. Accordingly, since a stop mechanism by the rotation of the operation cover part can be provided in the slider with a relatively simple configuration, the manufacturing cost can be reduced and the productivity can be improved.

10 Claims, 10 Drawing Sheets

(56) References Cited

U.S. PATENT DOCUMENTS

| | | | |
|---|---|---|---|
| 4,221,027 | A | 9/1980 | Oda |
| 4,438,550 | A | 3/1984 | Oda |
| 4,951,485 | A | 8/1990 | Wake |
| 5,152,036 | A | 10/1992 | Oda et al. |
| 5,611,121 | A | 3/1997 | Akeno et al. |
| 7,360,285 | B2 | 4/2008 | Takazawa |

FOREIGN PATENT DOCUMENTS

| | | | |
|---|---|---|---|
| JP | 55-443 | Y2 | 1/1980 |
| JP | S62-032415 | Y2 | 8/1987 |
| JP | H01-168767 | U | 11/1989 |
| JP | H11-068767 | U | 11/1989 |
| JP | H07-028369 | Y2 | 6/1995 |
| TW | 299592 | U | 3/1997 |

OTHER PUBLICATIONS

Office Action with Search Report, Taiwanese Patent Application No. 108117824, dated Sep. 21, 2020.
Office Action, Japanese Patent Application No. 2020-560729, dated Jan. 25, 2022, 8 pages.
International Search Report, PCT Patent Application No. PCT/JP2018/047047, dated Feb. 19, 2019.
Extended European Search Report, European Patent Application No. 18943972.2, dated Nov. 25, 2021, 7 pages.
Decision of Refusal, Japanese Patent Application No. 2020-560729, dated Aug. 4, 2022, 8 pages.

* cited by examiner

SLIDER FOR SLIDE FASTENER

TECHNICAL FIELD

The invention relates to a slider used for a slide fastener.

BACKGROUND ART

A slider used for a slide fastener can couple or separate element rows by sliding along right and left element rows provided on a fastener tape. Such a slider generally includes a slider body and a tab rotatably held with respect to the slider body, and a substantially Y-shaped element guide path that guides the right and left element rows is formed between upper and lower wing plates of the slider body.

As one of the sliders, an automatic stop mechanism is known, which can hold a stopped state of the slider (in other words, hold the slider at a stop position of the element row) by automatically projecting a part of a stop tab body into the element guide path of the slider body to engage the stop tab body with fastener elements of the element row when the slider is stopped at an arbitrary position on the element row.

Instead of the tab as described above, a slider including a rotation body that is rotatably provided with respect to the slider body is described in a specification of Japanese Utility Model No. H7-28369 A (Patent Document 1) and a specification of Chinese Patent No. 105231602 (Patent Document 2). The slider including the rotation body described in Patent Documents 1 and 2 is formed to be capable of switching a locked state in which a part of a stop tab or a stop tab body is projected into an element guide path of a slider body to hold a stopped state of the slider, and an unlocked state (lock release state) in which a part of the stop tab or the stop tab body is retreated from the element guide path to release the locked state by rotating a rotation body with respect to the slider body.

Here, when the slider is switched to the locked state, a part of the stop tab or the stop tab body is projected to one of the right and left element rows and a part of the stop tab or the stop tab body is inserted into a gap between the fastener elements adjacent to each other of the corresponding element row (gap between coupling heads of the fastener element). Accordingly, a part of the stop tab or the stop tab body is engaged with the fastener elements and the slider can be held so as not to move at a stop position of the element row.

CITATION LIST

Patent Document

Patent Document 1: Japanese Utility Model No. H7-28369 A

Patent Document 2: Chinese Patent No. 105231602

SUMMARY OF INVENTION

Technical Problem

The sliders described in Patent Documents 1 and 2 include a stop mechanism capable of switching between a locked state and an unlocked state by rotating the rotation body as described above, but the stop mechanism is formed in a complicated structure. As a result, for example, in a case of Patent Document 1, since the number of components of the slider increases and a slider assembly work becomes complicated, an increase in manufacturing cost and a decrease in productivity are caused. In a case of Patent Document 2, since the components itself of the slider are formed in a complicated and fine shape, the manufacturing and management of the components are complicated, and the manufacturing cost is increased.

Further, in the sliders described in Patent Documents 1 and 2, a portion configuring the stop mechanism including the rotation body is formed to be large relative to the entire slider, and significantly affects the appearance of the slider. Therefore, an appearance quality of the slider was decreased, and a design of the slider was restricted in some case.

In a case of the sliders of Patent Documents 1 and 2, a user is required to perform an operation of switching the state of the slider from the unlocked state to the locked state by rotating the rotation body after the user stops the slider. Since such a switching operation of the rotation body makes the user feel troublesomeness, it has been required to improve operability of the slider.

The invention has been made in view of the above-mentioned problems in the related art, and a specific object of the invention is to provide a slider of which the stop mechanism capable of switching the state from the locked state to the unlocked state by the rotation operation is formed in a relatively simple structure, which can be easily assembled, and which can include the appearance quality and a design which are completely different from the slider including the rotation body of the related art.

Solution to Problem

In order to achieve the above object, there is provided a slider for a slide fastener, the slider comprising: a slider body part including an upper wing plate, a lower wing plate that forms an element guide path with the upper wing plate, and a connection column that connects the upper wing plate with the lower wing plate; a stop tab body that is swingably held in the slider body part; and a tab elastic member that projects a part of the stop tab body into the element guide path by biasing the stop tab body, in which a base part formed integrally on the upper wing plate and an operation cover part rotatably attached to the base part are disposed; the operation cover part includes a top plate part disposed opposite to an upper surface of the base part, and a pressing projecting part that projects from an inner surface of the top plate part and presses the stop tab body against a biasing force of the tab elastic member; the pressing projecting part has a structure in which by rotating the operation cover part, a locked state in which a part of the stop tab body is projected into the element guide path by biasing the stop tab body and an unlocked state in which the stop tab body is pressed by the pressing projecting part, whereby a part of the stop tab body is retreated from the element guide path can be switched therebetween.

In the slider according to the invention, it is preferable that the pressing projecting part is formed in a an arc shape centered on a rotation axis of the operation cover part in a bottom surface view of the operation cover part; the base part includes a housing recessed groove that is formed in an arc shape in a plan view of the base part and houses the pressing projecting part; the stop tab body is disposed to overlap with at least a part of the housing recessed groove; and the pressing projecting part includes a projecting part for release, which presses the stop tab body and holds the unlocked state, and a projecting part for lock, of which a projecting dimension from the top plate part is smaller than that of the projecting part for release.

In this case, it is preferable that the pressing projecting part includes a connecting projecting part that is continuously formed between the projecting part for release and the projecting part for lock, and a top end surface of the connecting projecting part is formed as an inclined surface smoothly inclined from the projecting part for release toward the projecting part for lock.

It is particularly preferable that the projecting part for release includes a first projecting part for release and a second projecting part for release, which are disposed in opposite ends of the pressing projecting part having an arc shape respectively; the projecting part for lock is disposed in a center part of the pressing projecting part having an arc shape; and the connecting projecting part includes a first connecting projecting part formed between the first projecting part for release and the projecting part for lock, and a second connecting projecting part formed between the second projecting part for release and the projecting part for lock.

Further, it is preferable that the housing recessed groove of the base part includes a regulating end surface that regulates a rotation of the operation cover part at a predetermined rotation angle of 90° or less each in a clockwise direction and in a counterclockwise direction from a reference position in which the slider is in the locked state.

In the slider according to the invention, it is preferable that the operation cover part includes at least one guide projecting part that projects from an inner surface of the top plate part, and is formed in an arc shape centered on a rotation axis of the operation cover part in a bottom surface view of the operation cover part; the base part includes a guide recessed groove that is formed in an arc shape in a plan view of the base part and houses the guide projecting part, and at least one spring housing part connected to the guide recessed groove; at least one guiding elastic member, which biases the guide projecting part, is housed in the spring housing part; and the guide projecting part of the operation cover part is held in the guide recessed groove when the operation cover part is in a reference position in which the slider is in the locked state, and advances into the spring housing part to be disposed in a position in which the guide projecting part is biased by the guiding elastic member when the operation cover part is rotated from the reference position.

In this case, it is preferable that the guide projecting part includes a pair of first guide projecting part and second guide projecting part, which has shapes symmetric to each other and is disposed in positions symmetric to each other in a bottom surface view of the operation cover part; and one guiding elastic member is disposed in a center part of the slider in a width direction, and biases the first guide projecting part or the second guide projecting part when the operation cover part is rotated from the reference position.

In the invention, it may be that, in a plan view of the base part, the guiding elastic member includes a pair of first guiding elastic member and second guiding elastic member, which is housed in positions symmetric to each other, of the base part; and the one guide projecting part is disposed in a center part of the slider in a width direction and is biased by the first guiding elastic member or the second guiding elastic member when the operation cover part is rotated from the reference position.

Further, in the slider according to the invention, it is preferable that the base part includes a tab body housing recessed part that houses the stop tab body; the operation cover part includes a projecting part for a tab, which projects from an inner surface of the top plate part and presses a part of the stop tab body housed in the tab body housing recessed part; and the projecting part for a tab is formed in an inner side from the pressing projecting part and formed in an arc shape centered on a rotation axis of the operation cover part in a bottom surface view of the operation cover part.

In the invention, the base part may include a tab body housing recessed part that houses the stop tab body, and a pair of tab body holding parts that rotatably holds a swing shaft part of the stop tab body.

Advantageous Effects of Invention

The slider according to the invention includes a slider body part that includes an upper wing plate, an lower wing plate and a connection column, a stop tab body that is swingably held in the slider body part, a base part that includes a tab elastic member biasing the stop tab body, integrally formed with the upper wing plate of the slider body part, and for example, having a circular shape in a plan view of the slider body part, and an operation cover part that is brought into sliding contact with an outer peripheral side surface of the base part and rotatably attached to the base part. The operation cover part includes a thin plate-like top plate part that is disposed opposite to an upper surface of the base part, a pressing projecting part that projects from an inner surface of the top plate part and presses the stop tab body against a biasing force of the tab elastic member; and the pressing projecting part has a structure in which by rotating the operation cover part, a locked state in which a part of the stop tab body is projected into an element guide path by biasing the stop tab body and an unlocked state (lock release state) in which the stop tab body is pressed by the pressing projecting part, whereby a part of the stop tab body is retreated from the element guide path can be switched therebetween.

In the slider of the invention, a stop mechanism for switching between the locked state and the unlocked state of the slider by rotating the operation cover part can be formed by the pressing projecting part having a relatively simple and characteristic shape. The slider of the invention that includes the stop mechanism can be easily assembled by causing the operation cover part to be opposite to the upper surface of the base part and rotatably attaching the operation cover part to the base part in a state in which the stop tab body and the tab elastic member are set (housed or held) in a predetermined position of the slider.

Further, in the slider of the invention, since the slider body part is covered by the operation cover part from above, the slider body part can be made invisible or difficult to be seen from the upper surface side of the slider. Therefore, in the invention, it is possible to form a slider with an appearance quality completely different from that of the sliders described in the Patent Documents 1 and 2 described above, and with a new design which the slider in the related art does not have.

In the slider of the invention, the pressing projecting part of the operation cover part is formed in an arc shape centered on a rotation axis of the operation cover part in a bottom surface view of the operation cover part. The base part includes a housing recessed groove that is formed in an arc shape in a plan view of the base part and houses the pressing projecting part, and the stop tab body is disposed to overlap with at least a part of the housing recessed groove of the base part, preferably disposed across the housing recessed groove. Further, the pressing projecting part includes a projecting part for release and a projecting part for lock, of which projecting dimensions from the top plate part are different from each other. Since the base part and the operation cover part are formed in this way, the locked state and the unlocked state of the slider can easily be switched by rotating the operation cover part.

In this case, the pressing projecting part includes a connecting projecting part that is continuously formed between the projecting part for release and the projecting part for lock, and the connecting projecting part is formed such that a projecting dimension from the top plate part gradually decreases from the projecting part for release toward the projecting part for lock. Further, a top end surface (projecting end surface) disposed to be apart from the top plate part of the connecting projecting part is formed as an inclined surface that is smoothly inclined from the projecting part for release toward the projecting part for lock. Since the connecting projecting part is provided in the pressing projecting part, the pressing projecting part is difficult to be caught by the stop tab body when the operation cover part is rotated. Therefore, the unlocked state in which the stop tab body is pressed by the projecting part for release of the pressing projecting part and the locked state in which the stop tab body is held by the projecting part for lock of the pressing projecting part can be smoothly switched.

In this case, the pressing projecting part includes a first projecting part for release and a second projecting part for release, which are disposed in opposite ends of the pressing projecting part, a projecting part for lock, which is disposed in a center part of the pressing projecting part, a first connecting projecting part that is formed between the first projecting part for release and the projecting part for lock, and a second connecting projecting part that is formed between the second projecting part for release and the projecting part for lock. Therefore, the switching from the locked state to the unlocked state can be performed even when the operation cover part is rotated in a clockwise direction or in a counterclockwise direction from a reference position in which the slider is in the locked state in a plan view of the slider.

Further, the housing recessed groove of the base part can regulate the rotation of the operation cover part at a predetermined rotation angle of 90° or less in a clockwise direction and in a counterclockwise direction from the reference position. Accordingly, since the slider can be stably switched from the locked state to the unlocked state by rotating the operation cover part up to a predetermined angle of 90° or less, the switching to the unlocked state can be easily and reliably performed and operability of the slider can be improved.

In the slider of the invention, the operation cover part includes at least one guide projecting part that projects from the inner surface of the top plate part and is formed in an arc shape centered on the rotation axis of the operation cover part in a bottom surface view of the operation cover part. The base part includes a guide recessed groove that is formed in an arc shape in a plan view of the base part and houses the guide projecting part, and at least one spring housing part that is connected to the guide recessed groove. At least one guiding elastic member that biases the guide projecting part is housed in the spring housing part. Further, the guide projecting part of the operation cover part is held in the guide recessed groove when the operation cover part is in the reference position in which the slider is in the locked state, and advances into the spring housing part to be disposed in a position in which the guide projecting part is biased by the guiding elastic member in a direction in which the rotation of the operation cover part is returned when the operation cover part is rotated from the reference position.

Accordingly, for example, when a user finishes the sliding operation of the slider and releases fingers from the operation cover part, the operation cover part can be returned to the above-described reference position by the biasing force of the guiding elastic member. Therefore, an automatic stop mechanism that automatically switches the slider from the unlocked state to the locked state can be formed. With the automatic stop mechanism, the slider can be automatically switched from the unlocked state to the locked state in a slidable manner even when the user does not intend. Therefore, the operability of the slider can be significantly improved.

In this case, the guide projecting part includes a pair of first guide projecting part and second guide projecting part, which is symmetric to each other, and one guiding elastic member is disposed in the center part of the slider in a width direction. Accordingly, when the operation cover part is rotated in a clockwise direction or in a counterclockwise direction from the reference position, one of the first guide projecting part and the second guide projecting part can be stably biased by the guiding elastic member. Therefore, the above-described automatic stop mechanism can be stably implemented even when the operation cover part is rotated in any direction from the reference position.

In the invention, the guiding elastic member includes a pair of first guiding elastic member and second guiding elastic member, which is housed in positions symmetric to each other, of the base part in a plan view of the base part, and one guide projecting part may be disposed in the center part of the slider in the width direction. Accordingly, when the operation cover part is rotated in a clockwise direction or in a counterclockwise direction from the reference position, one guide projecting part can be stably biased by any one of the first guiding elastic member and the second guiding elastic member. Therefore, the above-described automatic stop mechanism can be stably implemented even when the operation cover part is rotated in any direction from the reference position.

Further, in the slider of the invention, the base part includes a tab body housing recessed part that houses the stop tab body, and the operation cover part includes a projecting part for a tab, which projects from the inner surface of the top plate part and presses a part of the stop tab body housed in the tab body housing recessed part. Further, the projecting part for a tab is formed inside from the pressing projecting part, and formed in an arc shape centered on the rotation axis of the operation cover part in a bottom surface view of the operation cover part. Accordingly, the stop tab body can be easily and stably attached to the upper wing plate so as to be swingable.

In the invention, instead of the projecting part for a tab described above included in the operation cover part, the base part may include a pair of tab body holding parts that rotatably holds the swing shaft part of the stop tab body.

Accordingly, also in this case, the stop tab body can be easily and stably attached to the upper wing plate so as to be swingable.

DESCRIPTION OF EMBODIMENTS

Hereinafter, preferred embodiments of the invention will be described in detail by using examples with reference to the drawings. The invention is not limited to the embodiments described below, and various modifications can be made as long as an invention has substantially the same configuration as the invention and exhibits the same effects.

For example, a slider described in the following embodiment is a slider used for a slide fastener including an element row in which a plurality of fastener elements are continuous in a coil shape. However, the invention is not limited to this, for example, the invention can also be applied to a slider used for a slide fastener including a plurality of independent fastener elements made of a synthetic resin, or a slider used for a slide fastener including a plurality of metal fastener elements.

Example 1

Figure 1:
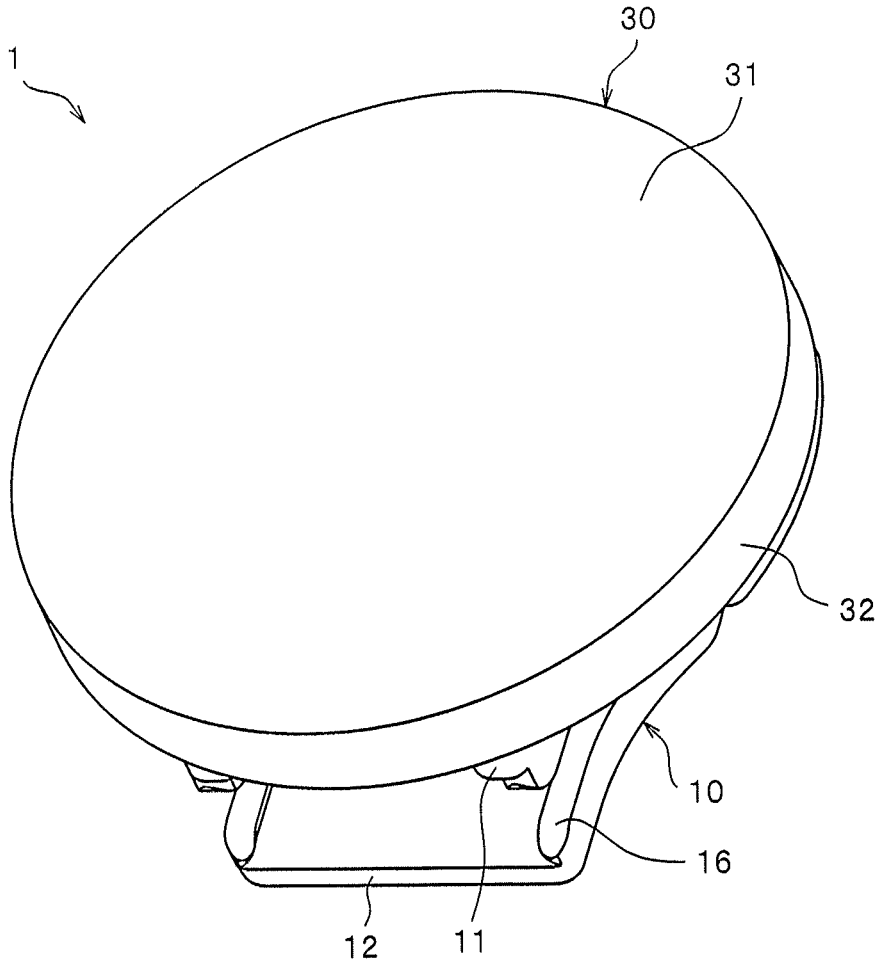
FIG. 1 is a perspective view schematically illustrating a slider according to Example 1 of the invention.
Figure 2:
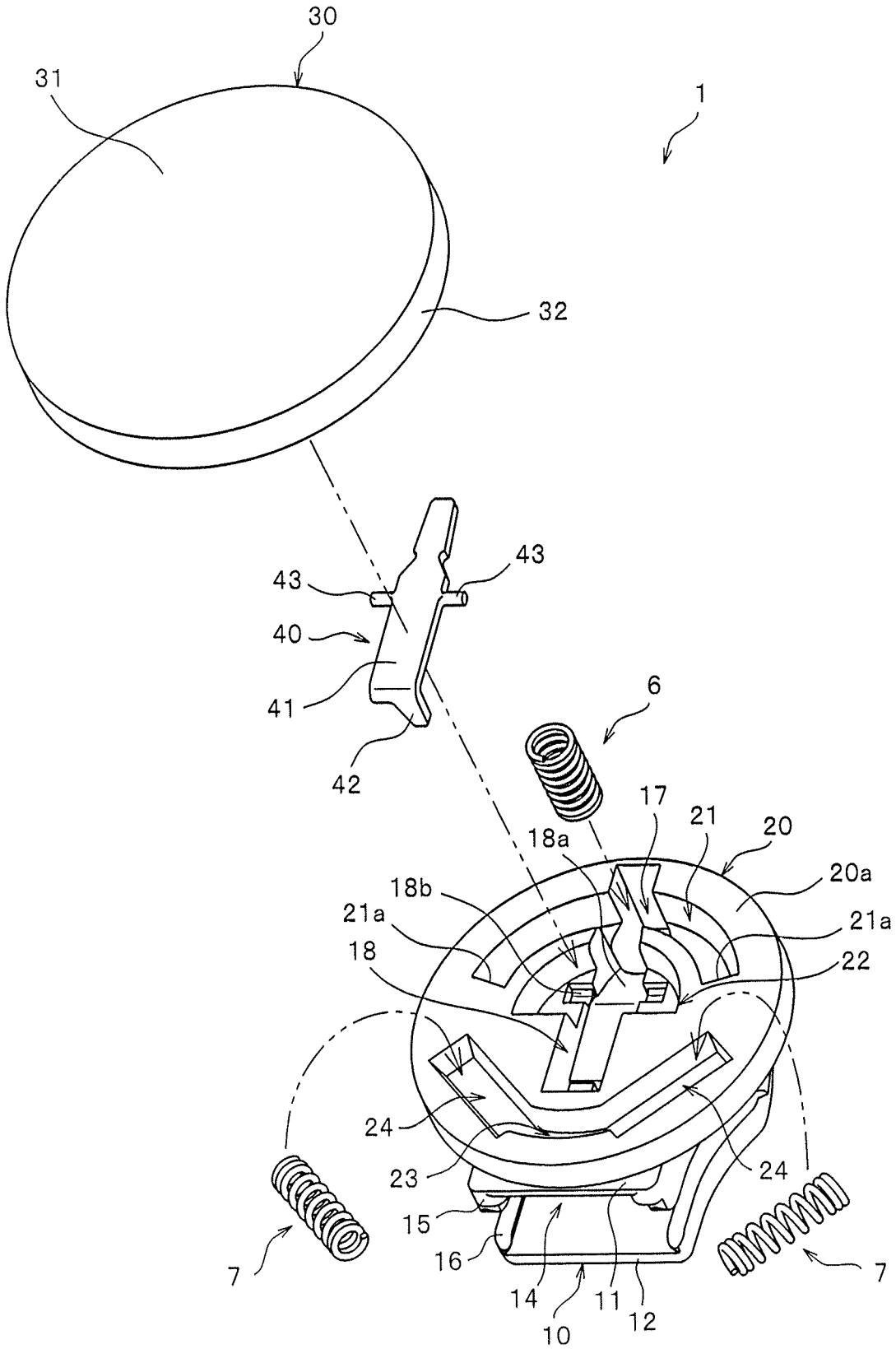
FIG. 2 is an exploded perspective view schematically illustrating a state in which a slider of Example 1 is disassembled.

FIG. 1 is a perspective view schematically illustrating a slider according to Example 1, and FIG. 2 is an exploded perspective view schematically illustrating a state in which the slider is disassembled.

In the following description, a sliding direction of the slider is defined as a front and rear direction or a longitudinal direction of the slider, and in particular, a direction in which the slider moves to couple the element rows of the slide fastener is set to a front direction, and a direction in which the slider moves to separate the element rows is set to a rear direction. A height direction of the slider is defined as a vertical direction, in particular, a direction from a lower wing plate to an upper wing plate of the slider or a direction in a side in which an operation cover part is attached to a base part of the slider is set to an upper direction, and a direction opposite to the upper direction is set to a lower direction. Further, a width direction orthogonal to the sliding direction and height direction of the slider is defined as a right and left direction.

As illustrated in FIG. 2, a slider 1 for a slide fastener of Example 1 includes a slider body part 10, a stop tab body 40 which is housed in the slider body part 10 and held swingably, one coil spring 6 for a tab (tab elastic member) and two guiding coil springs 7 (guiding elastic member) which are held in a predetermined position of the slider body part 10, and an operation cover part 30 which are rotatably engaged with the slider body part 10. Here, as the coil spring 6 for a tab and the coil springs 7 for guide, a general compression coil spring, which is made of a steel material and formed in a spiral shape, is used.

In the slider 1 of Example 1, the slider body part 10 and the operation cover part 30 are manufactured by die-casting a metal such as an aluminum alloy or a zinc alloy. The stop tab body 40 is manufactured by press-molding or die-casting a metal such as stainless steel or a copper alloy. In the invention, a material of the slider and the manufacturing method of each component are not particularly limited, for example, each of the slider body part 10 and the operation cover part 30 can be manufactured by injection-molding a thermoplastic resin such as polyamide and polyacetal instead of the metal described above.

The slider body part 10 of the Example 1 includes an upper wing plate 11, a lower wing plate 12 disposed in parallel with the upper wing plate 11, a connection column 13 that connects front end parts (end parts on a shoulder opening side) of the upper wing plate 11 and the lower wing plate 12, and a base part 20 that is integrally formed with the upper wing plate 11 on an upper surface side of the upper wing plate 11. Right and left shoulder openings are formed in a front end part of the slider body part 10 with the connection column 13 interposed between the right and left shoulder openings, and one rear opening is formed in a rear end part of the slider body part 10. Further, between the upper wing plate 11 and the lower wing plate 12 of the slider body part 10, a substantially Y-shaped element guide path 14 that communicates with the right and left shoulder openings and the rear opening is formed.

Further, right and left flange parts 15 extending toward the lower wing plate 12 are provided on the right and left sides of the upper wing plate 11, and right and left rib parts 16 projecting toward the upper wing plate 11 are provided on the right and left sides of the lower wing plate 12. In this case, between the right and left flange parts 15 and the right and left rib parts 16, a tape insertion gap for inserting a fastener tape is continuously formed from the shoulder opening to the rear opening of the slider body part 10 when the slide fastener is formed.

The base part 20 of the slider body part 10 is integrally formed with the upper wing plate 11 in a disk-like shape of which an appearance of a cross section orthogonal to a height direction is circular. In the case of Example 1, a portion forming an upper wall surface of the element guide path 14 is the upper wing plate 11, and the disk-shaped portion is the base part 20, but if necessary, the upper wing plate 11 and the base part 20 may be collectively referred to as a base part (or upper wing plate).

The base part 20 includes a flat upper surface 20*a* disposed to be orthogonal to the height direction, a cylindrical outer peripheral side surface, and a lower surface disposed on the opposite side of the upper surface 20*a*, and the outer peripheral side surface formed to have a ridge part with respect to the upper surface 20*a* and the lower surface has a predetermined height dimension (dimension in a vertical direction) over the whole peripheral direction of the base part 20 and is formed to have a flat and smooth curved surface.

Figure 5:
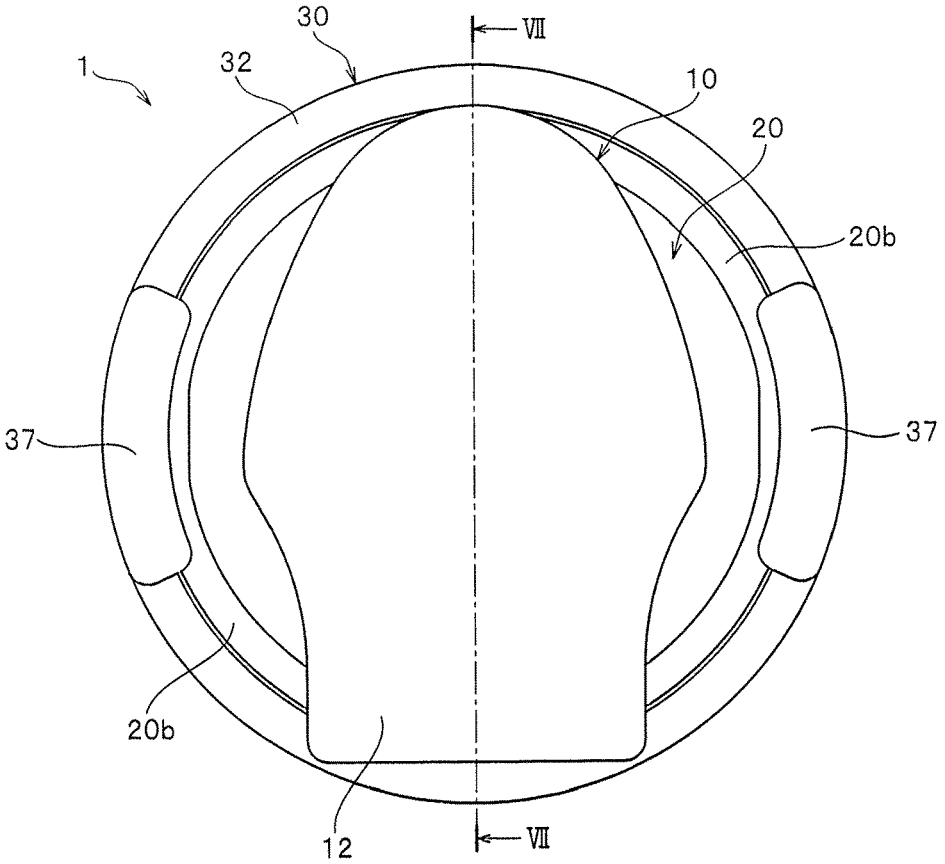
FIG. 5 is a bottom surface view of a slider of Example 1 when seen from below.
Figure 6:
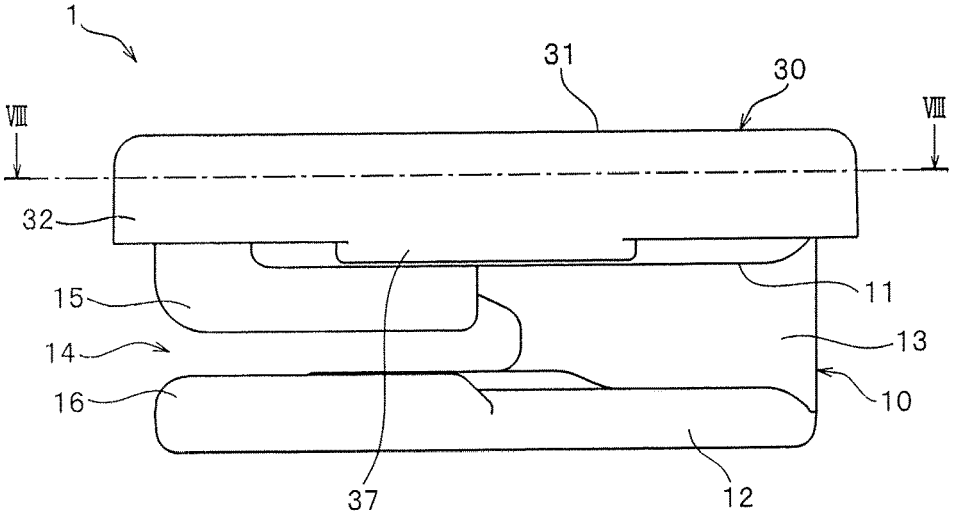
FIG. 6 is a right side view of a slider of Example 1 when seen from a right side.

As illustrated in FIG. 5, for example, a diameter of the base part 20 of Example 1 is set to be larger than a maximum value of a width dimension (dimension in a right and left direction) of the lower wing plate 12, and is set to be smaller than a maximum value of a longitudinal dimension (dimension in a front and rear direction) of the lower wing plate 12. Since the base part 20 has the diameter as described above, the operation cover part 30 can be easily attached to the base part 20 in the manufacturing process of the slider 1. When the operation cover part 30 is rotated with respect to the base part 20, a rotation operation of the operation cover part 30 can be easily performed.

At least a part of right and left attaching piece parts 37 of the operation cover part 30, which will be described later, is inserted into the outer peripheral edge part of the lower surface side of the base part 20, and the sliding contact part (sliding contact recessed part) 20*b* for bringing the right and left attaching piece parts 37 into slide contact is provided. For example, in a bottom surface view (FIG. 5) of the slider body part 10, the sliding contact part 20*b* is disposed in a region that does not overlap with the lower wing plate 12 of the base part 20, and is disposed in a position in which a thickness dimension of the base part 20 is reduced to have a level difference with respect to a lower surface of the center side of the base part 20 (position close to the upper surface 20*a* of the base part 20).

Figure 7:
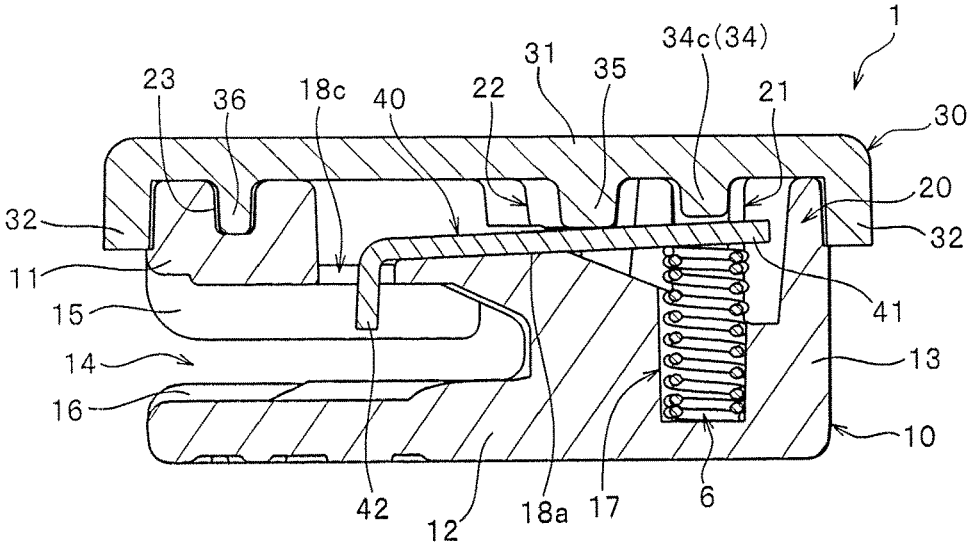
FIG. 7 is a cross-sectional view taken along line VII-VII illustrated in FIG. 5.
Figure 9:
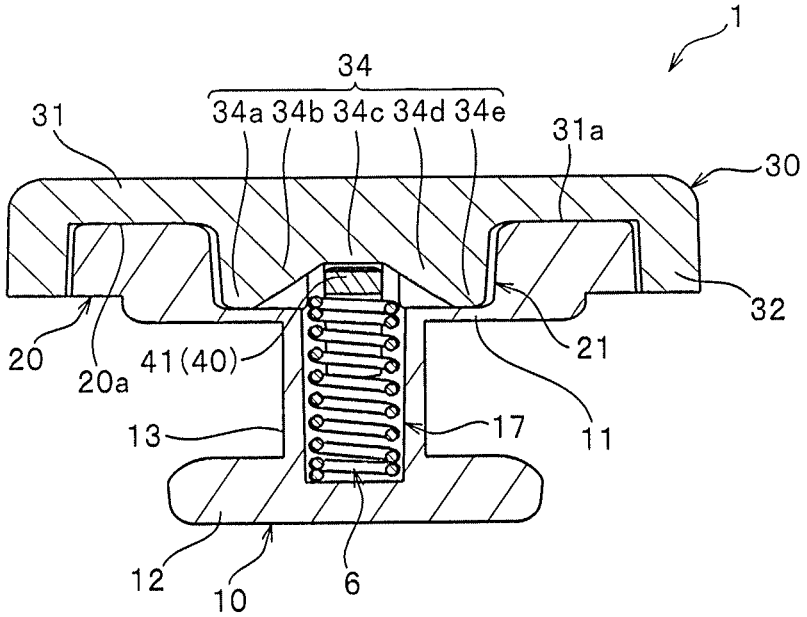
FIG. 9 is a cross-sectional view taken along line IX-IX illustrated in FIG. 8.

As illustrated in FIGS. 7 and 9, a bottomed housing hole 17 housing and holding the coil spring 6 for a tab is formed along the height direction in the front end part of the slider body part 10. In a plan view of the slider body part 10, the bottomed housing hole 17 is provided in a region in which the connection column 13 is formed, and is opened to the upper surface 20*a* of the base part 20. A size of the bottomed housing hole 17 can be arbitrarily changed according to a size of the coil spring 6 for a tab which is held in the bottomed housing hole 17.

A tab body housing recessed part 18 in which the stop tab body 40 is inserted to be housed is formed to be opened to the upper surface 20*a* of the base part 20 in the slider body part 10. The tab body housing recessed part 18 includes a body housing recessed part 18*a* that is formed along a longitudinal direction of the slider 1 and houses a tab body part of the stop tab body 40 which will be described later, right and left shaft housing recessed part 18*b* that is formed along a width direction from the body housing recessed part 18*a* and houses a swing shaft part 43, which will be described later, of the stop tab body 40, and a tab hole part 18*c* that is formed in a rear end part of the body housing recessed part 18*a* and communicates with the element guide path 14.

The body housing recessed part 18*a* of the tab body housing recessed part 18 communicates with the bottomed housing hole 17 of the slider body part 10. As illustrated in FIG. 7, in order to allow a swing operation of the stop tab body 40, a bottom surface of the body housing recessed part 18*a* includes an upward inclination part that inclines upward such that a depth dimension of the body housing recessed part 18*a* gradually deceases toward the front from the tab hole, and a downward inclination part that inclines downward such that a depth dimension of the body housing recessed part 18*a* gradually increases toward the bottomed housing hole 17 (toward the front).

Further, the base part 20 of Example 1 includes a housing recessed groove 21 formed in an arc shape in a front half part of the base part 20, a central housing recessed part 22 recessed in a semicircular shape inside in a radial direction from the housing recessed groove 21, a guide recessed groove 23 formed in an arc shape in a rear end part of the base part 20, and a pair of right and left spring housing parts 24 recessed linearly in right and left sides of the guide recessed groove 23.

In this case, the arc-shaped housing recessed groove 21, an arc-shaped front inner wall surface forming the central housing recessed part 22, and the arc-shaped guide recessed groove 23 are formed in a concentrically circular shape centered on a rotation axis of the operation cover part 30 in a plan view of the base part 20. The bottom surface of each of the housing recessed groove 21, the central housing recessed part 22, the guide recessed groove 23, and the right and left spring housing parts 24 is disposed in a position shallower than the bottom surface of the body housing recessed part 18*a* described above (height position close to the upper surface 20*a* of the base part 20) in the height direction of the slider body part 10.

When the operation cover part 30 is attached to the base part 20 in a predetermined direction, the housing recessed groove 21 is formed in a position and a size in which a pressing projecting part 34, which will be described later, of the operation cover part 30 can be housed at the time of inserting the pressing projecting part 34 and a housing state of the pressing projecting part 34 can be maintained even when the operation cover part 30 is rotated. The housing recessed groove 21 is also formed so as to cross the body housing recessed part 18*a* of the tab body housing recessed part 18 described above substantially in the width direction. Therefore, when the stop tab body 40 is housed in the tab body housing recessed part 18, the stop tab body 40 is held in a state in which the stop tab body 40 intersects the housing recessed groove 21 along the longitudinal direction.

A depth dimension of the housing recessed groove 21, that is, a dimension in the vertical direction from the position of the upper surface 20*a* of the base part 20 to the bottom surface of the housing recessed groove 21 (hereinafter, the dimension to such a bottom surface is abbreviated as a depth dimension) is constant in a region excluding a portion of the housing recessed groove 21 that crosses the body housing recessed part 18*a*.

The housing recessed groove 21 includes right and left side end surfaces 21*a* formed of surfaces orthogonal to a peripheral direction of the base part 20 and parallel to the vertical direction in opposite right and left end parts of the housing recessed groove 21, and the right and left side end surfaces 21*a* are used as right and left regulating end surfaces that regulate an angle at which the operation cover part 30 can be rotated. That is, the right and left side end surfaces (regulating end surfaces) 21*a* formed in the housing recessed groove 21 can regulate an angle at which the operation cover part 30 can be rotated by bring the pressing projecting part 34 of the operation cover part 30 into contact with the right and left side end surfaces (regulating end surfaces) 21*a* when the operation cover part 30 is rotated in a case in which the pressing projecting part 34 of the operation cover part 30 is inserted and housed in the housing recessed groove 21 of the base part 20.

In Example 1, the right and left side end surfaces (regulating end surfaces) 21*a* of the housing recessed groove 21 is disposed in a position in which the operation cover part 30 can be rotated up to 30° both in a clockwise direction and in a counterclockwise directions respectively from a reference position in which the slider 1 can be held in a locked state as will be described later in a plan view of the slider 1. That is, a rotatable range of the operation cover part 30 from the reference position in Example 1 is set to 30° or less both in the clockwise direction and in the counterclockwise direction. In other words, a rotation limit angle of the operation cover part 30 from the reference position is 30° both in the clockwise direction and in the counterclockwise direction.

In the invention, the rotatable range of the operation cover part 30 in the clockwise direction and in the counterclockwise direction is set to 90° or less from the reference position, preferably 45° or less by the right and left side end surfaces (regulating end surfaces) 21*a* of the housing recessed groove 21 in consideration of a structure of the base part 20. Since the guide recessed groove 23 and the spring housing parts 24 can be stably formed in the base part 20 by setting the rotatable range to 90° or less, the slider 1 can have a function that automatically returns the operation cover part 30 rotated as will described later to the reference position. Operability of the slider 1 when the slider 1 is slid in the unlocked state (that is, a state in which the operation cover part 30 is rotated to the rotation limit angle) can be improved.

Further, since the rotatable range is set to 45° or less such that a user can easily rotate the operation cover part 30 to the rotation limit angle by twisting a wrist or a finger, the operability in the unlocked state of the slider 1 described above can be further improved. In addition, for example, a problem that switching to the unlocked state cannot be properly performed due to an insufficient rotation of the operation cover part 30 can be prevented and operability of the switching operation by the operation cover part 30 can be improved.

An extent that the stop tab body 40 is pressed down by the pressing projecting part 34, which will be described later, of the operation cover part 30 can be smoothly changed by setting the rotation limit angle of the operation cover part 30 to 10° or more, preferably 20° or more, and according to this, switching from the locked state to the unlocked state of the slider 1 can be stably performed. In particular, in comprehensive consideration of operability in the unlocked state of the slider 1 as described above, operability of the switching operation, and smoothness and stability of switching to the unlocked state, the rotation limit angle of the operation cover part 30 is preferably set to 30° as in Example 1.

When the operation cover part 30 is attached to the base part 20 in a predetermined direction, the central housing recessed part 22 having a semicircular shape and recessed in the base part 20 is formed in a position and a size in which a projecting part 35 for a tab, which will be described later, of the operation cover part 30 can be housed at the time of inserting the projecting part 35 for a tab and a housing state of the projecting part 35 for a tab can be maintained even when the operation cover part 30 is rotated. The central housing recessed part 22 may be formed in an arc shape centered on a rotation axis of the operation cover part 30 as long as the projecting part 35 for a tab of the operation cover part 30 can be housed.

The arc-shaped guide recessed groove 23 is recessed in a central region in the width direction in the rear end part of the base part 20, and when the operation cover part 30 is attached to the base part 20 in a predetermined direction, a guide projecting part 36, which will be described later, of the operation cover part 30 can be inserted and housed. The guide recessed groove 23 communicates with a pair of right and left spring housing parts 24. In this case, the bottom surface of the guide recessed groove 23 and the bottom surface of each of the right and left spring housing parts 24 are formed as a continuous single flat surface, and a depth dimension of the guide recessed groove 23 and a depth dimension of the right and left spring housing parts 24 are equal to each other.

The right and left spring housing parts 24 are formed to have a rectangular shape in a plan view of the slider body part 10. In this case, the spring housing parts 24 are formed corresponding to the size of a guiding coil spring 7, and when one guiding coil spring 7 is housed in each of the spring housing parts 24, the guiding coil spring 7 can be held so as not to rattle. The right and left spring housing parts 24 are formed to have a size in which the guide projecting part 36 of the operation cover part 30 does not interfere with the base part 20 even when the operation cover part 30 attached to the base part 20 is rotated within a predetermined rotation angle range described above.

The stop tab body 40 includes a flat plate-shaped substrate part 41, a tab part 42 that is bent downward and extends from a rear end part of the substrate part 41, and a pair of right and left cylindrical swing shaft parts 43 that extend in a width direction from substantially a center part of the substrate part 41 in a longitudinal direction. A dimension of the substrate part 41 in the longitudinal direction (that is, dimension from a front end edge of the substrate part 41 to a boundary part (bending part) with the tab part 42) is set to be larger than a half of a maximum longitudinal dimension of the lower wing plate 12 of the slider body part 10. Accordingly, in the slider 1, when a front end part of the substrate part 41 of the stop tab body 40 is pressed down, the tab part 42 of the stop tab body 40 can be stably retracted from the element guide path 14.

A tip of the tab part 42 is formed to have a width dimension smaller than that of a base end part of the tab part 42, which is connected to the substrate part 41, and is provided to be displaced to a right side or a left side with respect to the base end part. Since the tip of the tab part 42 is displaced in the right and left direction in this way, the tip of the tab part 42 can be stably inserted to and engaged with one of the coupled right and left element rows.

Figure 4:
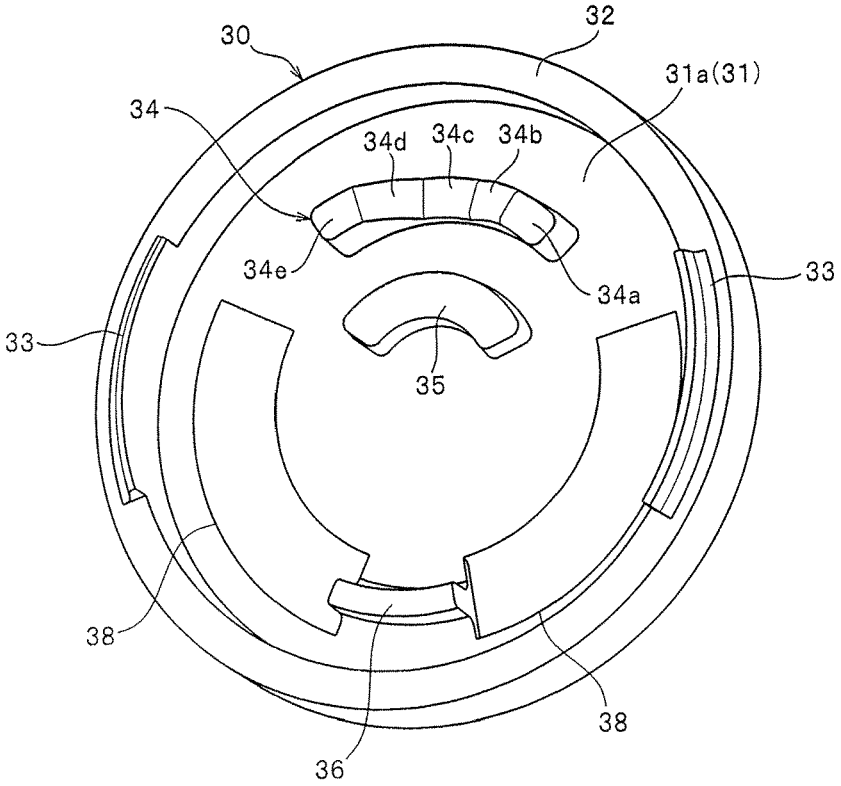
FIG. 4 is a perspective view of an operation cover part of Example 1 when seen from an inner surface side of the operation cover part.

As illustrated in FIG. 4, in a state before the operation cover part 30 is attached to the slider body part 10, the operation cover part 30 includes a disk-shaped top plate part 31, a ring-shaped sliding contact wall 32 that projects in a direction orthogonal to an inner surface 31*a* of the top plate part 31 from an outer periphery edge part of the top plate part 31, a pair of arc-shaped right and left projection parts 33 that projects further from a tip surface of the sliding contact wall 32, the pressing projecting part 34 and the projecting part 35 for a tab that project from the inner surface 31*a* in a front half part of the top plate part 31, and the guide projecting part 36 that projects from the inner surface 31*a* in a rear end part of the top plate part 31.

The top plate part 31 of the operation cover part 30 has a circular shape in a plan view of the slider 1, and includes a flat outer surface (upper surface) and an inner surface (lower surface) 31*a*. In this case, a diameter of the circular top plate part 31 is larger than a diameter of the base part 20, and is larger than the maximum longitudinal dimension of the lower wing plate 12. Accordingly, since the slider body part 10 can be covered by the top plate part 31 from above when the operation cover part 30 is attached to the slider body part 10, for example, when the assembled slider 1 of Example 1 is seen from above, the slider body part 10 is hidden in a rear surface side of the top plate part 31 and only circular top plate part 31 can be visually recognized.

As a result, the slider 1 of Example 1 can have a simple and refined appearance that cannot be obtained by the slider in the related art, and for example, can be easily differentiated from other sliders. In Example 1, characters and logos can be printed or engraved and various decorations can be applied on the outer surface (upper surface) of the top plate part 31. According to this, it is possible to improve an appearance quality of the slider 1 and increase originality and rarity of the slider 1.

When the operation cover part 30 is attached to the slider body part 10, the sliding contact wall 32 is formed such that the inner peripheral wall surface of the sliding contact wall 32 is in contact with the entire outer peripheral side surface of the base part 20. Accordingly, it is possible to prevent the operation cover part 30 attached to the slider body part 10 from rattling. When the operation cover part 30 attached to the slider body part 10 is rotated, the inner peripheral wall surface of the sliding contact wall 32 can be brought into sliding contact with the outer peripheral side surface of the base part 20. Accordingly, the operation cover part 30 can be stably rotated around a constant rotation axis with respect to the slider body part 10.

In the sliding contact wall 32 of Example 1, the outer peripheral side surface of the sliding contact wall 32 is formed in a smooth cylindrical shape. Therefore, a good touch of the slider 1 can be obtained and a refined appearance of the slider 1 is maintained. On the other hand, the outer peripheral side surface of the sliding contact wall 32 of the operation cover part 30 is a portion that the user holds with fingers when the operation cover part 30 is rotated, which will be described later. Therefore, in the invention, in order to improve the operability of the operation of rotating the operation cover part 30, an anti-slipping fine unevenness, a recessed part corresponding to a thickness of a finger, a protrusion that hooks a finger, and the like can be formed in the outer peripheral side surface of the sliding contact wall 32, and an anti-slipping rubber material, and the like can be attached to the outer peripheral side surface of the sliding contact wall 32.

In Example 1, the right and left projection parts 33 provided on the operation cover part 30 can be plastically deformed into right and left thin plate-like attaching piece parts 37 illustrated in FIG. 5 by being pressed down toward a center part which is a rotation axis of the operation cover part 30, or by being pressed and crushed toward the sliding contact wall 32 after the base part 20 of the slider body part 10 is covered by the operation cover part 30.

By plastically deforming the projection parts 33 into the attaching piece parts 37 in this way, the operation cover part 30 can be rotatably and stably attached to the base part 20 of the slider body part 10, and the attached operation cover part 30 can be prevented from being removed from the slider body part 10. In the invention, means or a method for rotatably attaching the operation cover part 30 to the base part 20 of the slider body part 10 is not particularly limited, and other attachment means or attachment methods can also be adopted.

The pressing projecting part 34 of the operation cover part 30 is provided corresponding to a forming position of the housing recessed groove 21 so as to be inserted into the housing recessed groove 21 of the base part 20 when the operation cover part 30 is attached to the slider body part 10. The pressing projecting part 34 is formed in an arc shape centered on the rotation axis of the operation cover part 30 in a bottom surface view of the operation cover part 30. Therefore, the pressing projecting part 34 can smoothly move without being caught in the arc-shaped housing recessed groove 21 of the base part 20 when the operation cover part 30 is attached to the slider body part 10 and rotated.

The pressing projecting part 34 includes a left first projecting part 34*a* for release and a right second projecting part 34*e* for release which are arranged in opposite right and left end parts of the pressing projecting part 34 and of which a projecting dimension (dimension in a vertical direction) from the inner surface 31*a* of the top plate part 31 is largest, a projecting part 34*c* for lock which is arranged in a center part of the pressing projecting part 34 and of which a projecting dimension from the inner surface 31*a* of the top plate part 31 is smallest, a first connecting projecting part 34*b* which is continuously formed between the first projecting part 34*a* for release and the projecting part 34*c* for lock, and a second connecting projecting part 34*d* which is continuously formed between the second projecting part 34*e* for release and the projecting part 34*c* for lock.

In this case, the first connecting projecting part 34*b* and the second connecting projecting part 34*d* are formed such that the projecting dimension from the top plate part 31 gradually decreases from the first projecting part 34*a* for release or the second projecting part 34*e* for release toward the projecting part 34*c* for lock. A top end surface of the first connecting projecting part 34*b* and a top end surface of the second connecting projecting part 34*d* are formed as an inclined surface continuously inclined from the first projecting part 34*a* for release or the second projecting part 34*e* for release toward the projecting part 34*c* for lock, and each of the top end surfaces inclined toward one side is formed as a smoothly continuous surface without steps. Here, the top end surface of the first connecting projecting part 34*b* and the top end surface of the second connecting projecting part 34*d* are surfaces (projecting end surfaces) formed to be apart from the top plate part 31 in the vertical direction in a projecting distal end part of the first connecting projecting part 34*b* and the second connecting projecting part 34*d*, which project from the top plate part 31.

In the slider 1 of Example 1, by forming the pressing projecting part 34 as described above, for example, in a state in which the operation cover part 30 is held in the reference position in which the projecting part 34*c* for lock of the pressing projecting part 34 is positioned immediately above the stop tab body 40, the projecting part 34*c* for lock of the pressing projecting part 34 is slightly separated from the stop tab body 40 as illustrated in FIG. 9 (or contacts the stop tab body 40 to the extent that the stop tab body 40 is not pressed downward). Therefore, a front end part of the stop tab body 40 is biased upward by the coil spring 6 for a tab, and a state in which the front end part of the stop tab body 40 is held in the highest position is maintained. Accordingly, since the tab part 42 of the stop tab body 40 is projected into the element guide path 14 of the slider body part 10, the slider 1 can be held in a locked state in which the slider 1 cannot slide on the element row.

On the other hand, for example, by rotating the operation cover part 30 in the clockwise direction or in the counterclockwise direction, the first projecting part 34*a* for release or the second projecting part 34*e* for release of the pressing projecting part 34 can be moved immediately above the stop tab body 40. Accordingly, by bringing the first projecting part 34*a* for release or the second projecting part 34*e* for release into contact with the front end part of the stop tab body 40, the front end part of the stop tab body 40 can be pressed downward against the biasing force of the coil spring 6 for a tab to be pressed down. As a result, since the tab part 42 of the stop tab body 40 is retreated from the element guide path 14 of the slider body part 10, the slider 1 can be held in an unlocked state in which the slider 1 can slide on the element row.

Further, since the pressing projecting part 34 of Example 1 is provided with the first connecting projecting part 34*b* and the second connecting projecting part 34*d* including the smoothly inclined top end surface without steps as described above, the front end part of the stop tab body 40 can be brought into sliding contact with the first connecting projecting part 34*b* or the second connecting projecting part 34*d*, whereby the front end part of the stop tab body 40 is gradually pressed down when the operation cover part 30 is rotated from the reference position (locked state of the slider 1) to move the first projecting part 34*a* for release or the second projecting part 34*e* for release of the pressing projecting part 34 to the position immediately above the stop tab body 40. As a result, the slider 1 can be smoothly and stably switched from the locked state to the unlocked state.

Similarly, when the operation cover part 30 is rotated from the unlocked state of the slider 1 to move the projecting part 34*c* for lock of the pressing projecting part 34 to the position immediately above the stop tab body 40, the front end part of the stop tab body 40 can be brought into sliding contact with the first connecting projecting part 34*b* or the second connecting projecting part 34*d*, thereby being gradually raised by the biasing force of the coil spring 6 for a tab. As a result, the slider 1 can be smoothly and stably switched from the unlocked state to the locked state.

The projecting part 35 for a tab of the operation cover part 30 is formed inside from the pressing projecting part 34 in a radial direction, and formed in an arc shape centered on the rotation axis of the operation cover part 30 in a bottom surface view of the operation cover part 30. The projecting part 35 for a tab is formed so that the projecting dimension of the projecting part 35 for a tab from the inner surface 31*a* of the top plate part 31 is constant. In this case, the projecting dimension of the projecting part 35 for a tab from the inner surface 31*a* of the top plate part 31 is set to be larger than the projecting dimension of the projecting part 34*c* for lock of the pressing projecting part 34 from the inner surface 31*a* of the top plate part 31 and is set to be smaller than the projecting dimension of the first projecting part 34*a* for release and the second projecting part 34*e* for release of the pressing projecting part 34 from the inner surface 31*a* of the top plate part 31.

When the operation cover part 30 is attached to the slider body part 10, the projecting part 35 for a tab is inserted and housed in the central housing recessed part 22 of the base part 20, and is brought into contact with the upper surface of the stop tab body 40 housed in the tab body housing recessed part 18 of the base part 20. When the operation cover part 30 is attached to the slider body part 10 and is rotated, the projecting part 35 for a tab can be smoothly moved in the central housing recessed part 22 of the base part 20 without being caught. Further, even when the operation cover part 30 is rotated within the predetermined rotatable range described above, the projecting part 35 for a tab can be held in a state of being in contact with the upper surface of the stop tab body 40 housed in the tab body housing recessed part 18 constantly, whereby the stop tab body 40 can be prevented from coming off the tab body housing recessed part 18, and the stop tab body 40 can be stably held so as to be swingable in the vertical direction in the tab body housing recessed part 18.

The guide projecting part 36 of the operation cover part 30 is formed in an arc shape centered on the rotation axis of the operation cover part 30 in a rear end part of the operation cover part 30, and is formed such that a projecting dimension from the inner surface 31*a* of the top plate part 31 is constant. When the operation cover part 30 is attached to the slider body part 10 in the reference position, the guide projecting part 36 is inserted and housed in the guide recessed groove 23 of the base part 20. Further, by rotating the operation cover part 30 in the clockwise direction or in the counterclockwise direction within the predetermined rotatable range described above, the guide projecting part 36 advances into one of the right and left spring housing parts 24 of the base part 20, and a biasing force in a direction in which the guide projecting part 36 returns to the guide recessed groove 23 (direction in which the rotation returns) is applied by the guiding coil springs 7 held in the spring housing parts 24.

In the operation cover part 30 of Example 1, right and left avoidance recessed parts 38 are provided on right and left sides of the guide projecting part 36 to prevent the inner surface 31*a* of the operation cover part 30 from coming into contact with the guiding coil springs 7 guide. In this case, the right and left avoidance recessed parts 38 are provided in an arc shape centered on the rotation axis of the operation cover part 30.

Next, a method for assembling the slider 1 of Example 1 by using the slider body part 10, the stop tab body 40, the coil spring 6 for a tab, two guiding coil springs 7, and the operation cover part 30 as described above is described.

Figure 3:
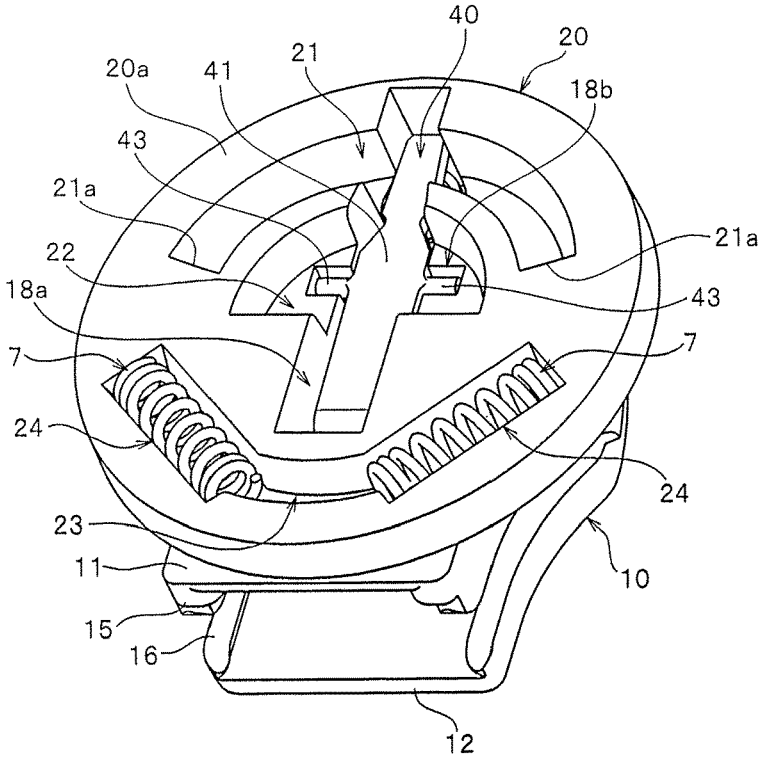
FIG. 3 is a perspective view schematically illustrating a state before an operation cover part is attached in a slider of Example 1.

First, as shown by an arrow of a virtual line in FIG. 2, the coil spring 6 for a tab is inserted into the bottomed housing hole 17 of the slider body part 10 from above, and then the stop tab body 40 is inserted and housed in the tab body housing recessed part 18 of the slider body part 10. At this time, a front end part of the substrate part 41 of the stop tab body 40 is placed on the coil spring 6 for a tab. Further, two guiding coil springs 7 guide are inserted into the right and left spring housing parts 24 of the base part 20 respectively one by one. Accordingly, the coil spring 6 for a tab, the stop tab body 40, and two guiding coil springs 7 are assembled to the slider body part 10 as illustrated in FIG. 3.

Next, the operation cover part 30 is attached so as to cover the base part 20 of the slider body part 10. At this time, the sliding contact wall 32 of the operation cover part 30 is brought into contact with the entire outer peripheral side surface of the base part 20, and the operation cover part 30 is directed so as to house at least the guide projecting part 36 in the guide recessed groove 23 of the base part 20. Accordingly, the operation cover part 30 can be temporarily held in the reference position in which the locked state of the slider 1 is maintained with respect to the base part 20 of the slider body part 10.

After the operation cover part 30 is temporarily held to the slider body part 10, the right and left projection parts 33 provided on the operation cover part 30 are pressed so as to fall down toward the inside of the operation cover part 30 in the width direction, or pressed such that the projection part 33 is crushed toward the sliding contact wall 32. Accordingly, the right and left projection parts 33 are plastically deformed, as illustrated in FIG. 5, the right and left attaching piece parts 37 are formed so as to extend toward the center part of the ring-shaped sliding contact wall 32, and each of the formed attaching piece parts 37 overlaps with a part of the sliding contact part (sliding contact recessed part) 20*b* provided on the lower surface side of the base part 20. By forming the right and left attaching piece parts 37 in this way, the operation cover part 30 is rotatably attached to the slider body part 10 both in the clockwise direction and in the counterclockwise direction in a plan view of the slider 1. Accordingly, the slider 1 of Example 1 illustrated in FIG. 1 is manufactured.

As described above, the slider 1 of Example 1 can be easily manufactured by relatively simple assembly processes.

After that, the slider 1 of Example 1 manufactured as described above is slidably attached to an element row formed of coil shaped fastener elements provided on a pair of right and left fastener stringers, whereby a slide fastener can be manufactured.

Figure 8:
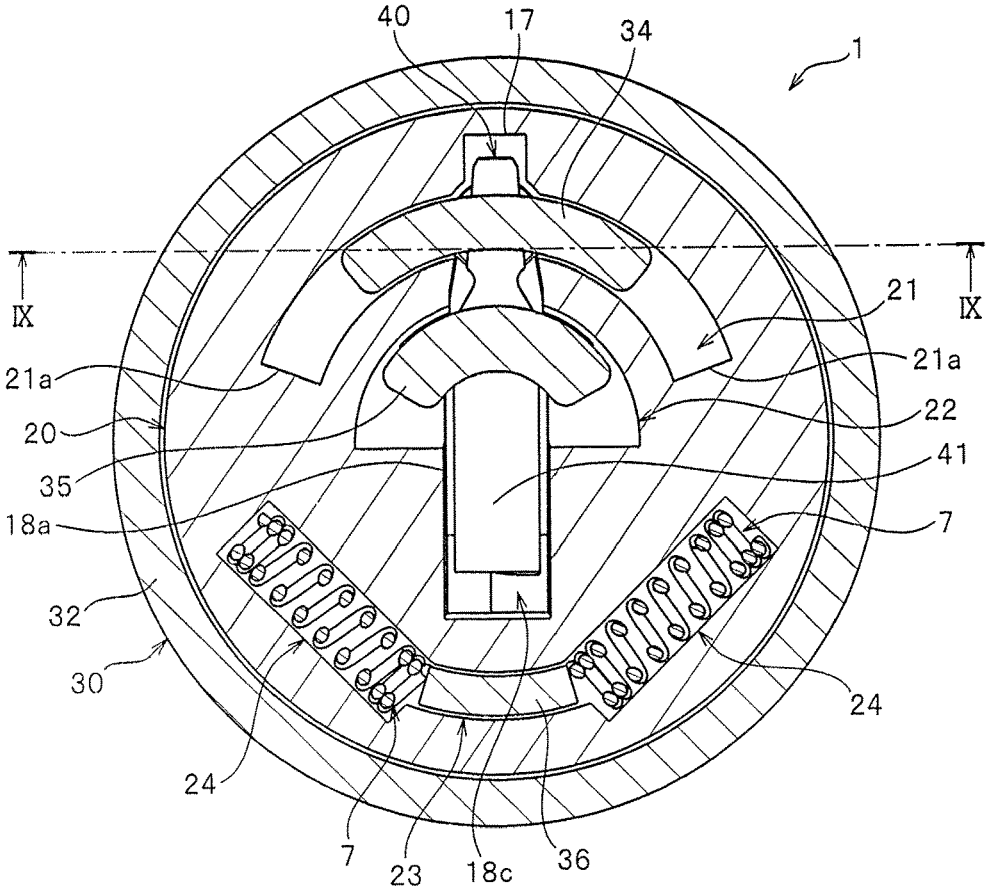
FIG. 8 is a cross-sectional view taken along line VIII-VIII illustrated in FIG. 6.

In the manufactured slider 1 of Example 1, when the operation cover part 30 is in a non-operation state in which the operation cover part 30 is not operated, for example, as illustrated in FIG. 8, the guide projecting part 36 of the operation cover part 30 is housed in the guide recessed groove 23 of the base part 20, and the guide projecting part 36 is interposed between the right and left guiding coil springs 7 so as to contact the right and left guiding coil springs 7. Accordingly, the guide projecting part 36 of the operation cover part 30 can be prevented from freely advancing into the right and left spring housing parts 24 in which the guiding coil spring 7 guide is housed, and can be held in the guide recessed groove 23.

When the guide projecting part 36 of the operation cover part 30 is held in the guide recessed groove 23 of the base part 20 as described above, as illustrated in FIG. 9, the projecting part 34*c* for lock disposed in the center part of the pressing projecting part 34 of the operation cover part 30 is disposed immediately above the stop tab body 40 in a state in which the projecting part 34*c* for lock is slightly separated from the stop tab body 40, and the front end part of the substrate part 41 of the stop tab body 40 is held to be in contact with the coil spring 6 for a tab. Accordingly, the tab part 42 of the stop tab body 40 can be projected into the element guide path 14 via the tab hole part 18*c* of the slider body part 10, and the tab part 42 can be maintained in a state in which the tab part 42 is projected into the element guide path 14. As a result, the slider 1 of the slide fastener can be held in the locked state of being locked by the stop tab body 40 so as not to move on the element row.

In the invention, the position (rotational position) of the operation cover part 30 when the slider 1 is held in the locked state as described above is defined as a reference position. In the reference position of the operation cover part 30, the guide projecting part 36 of the operation cover part 30 is held by the right and left guiding coil springs 7 so as not to move from the guide recessed groove 23 to the spring housing parts 24 as described above. Therefore, the operation cover part 30 can be stably held so as not to rotate from the reference position.

On the other hand, when the slider 1 of Example 1 is slid along the element row of the slide fastener, the user holds the operation cover part 30 of the slider 1 (particularly, the outer peripheral surface of the sliding contact wall 32 of the operation cover part 30) with fingers, and rotates the operation cover part 30 from the reference position either in the clockwise direction or in the counterclockwise direction in a plan view of the slider 1.

Accordingly, the guide projecting part 36 of the operation cover part 30 advances into one of the right and left spring housing parts 24 against the biasing force of the guiding coil spring 7. The pressing projecting part 34 of the operation cover part 30 moves in the housing recessed groove 21, which is formed in an arc shape, of the base part 20 as the operation cover part 30 is rotated. At this time, the pressing projecting part 34 brings the first connecting projecting part 34*b* or the second connecting projecting part 34*d* of the pressing projecting part 34, and the first projecting part 34*a* for release or the second projecting part 34*e* for release into contact with the substrate part 41 of the stop tab body 40 in order, whereby the front end part of the substrate part 41 can be pressed down against the biasing force of the coil spring 6 for a tab.

In particular, in Example 1, since the projecting dimension of the first connecting projecting part 34*b* and the second connecting projecting part 34*d* from the inner surface 31*a* of the top plate part 31 is changed to gradually increase from the projecting part 34*c* for lock of the pressing projecting part 34 toward the first projecting part 34*a* for release or the second projecting part 34*e* for release, the front end part of the substrate part 41 can be gradually and significantly pressed down against the biasing force of the coil spring 6 for a tab as the rotation angle of the operation cover part 30 is lager, and the stop tab body 40 can be rotated around the swing shaft part 43.

Then, by bringing the first projecting part 34*a* for release or the second projecting part 34*e* for release of the pressing projecting part 34 into contact with the substrate part 41 of the stop tab body 40, the front end part of the substrate part 41 is significantly pressed down by the pressing projecting part 34. Therefore, the slider 1 can be held in the unlocked state (lock release state) of being slidable along the element row by retreating the tab part 42 of the stop tab body 40 from the element guide path 14 of the slider body part 10.

In the case of Example 1, when the operation cover part 30 is rotated as described above to bring the first projecting part 34*a* for release or the second projecting part 34*e* for release of the pressing projecting part 34 into contact with the stop tab body 40, the pressing projecting part 34 is brought into contact with one of the right and left side end surfaces (regulating end surfaces) 21*a* formed in the housing recessed groove 21. Therefore, the rotation of the operation cover part 30 can be limited such that the operation cover part 30 does not rotate any more. Accordingly, since a state in which the first projecting part 34*a* for release or the second projecting part 34*e* for release of the pressing projecting part 34 is in contact with the stop tab body 40 is held, the unlocked state of the slider 1 can be stably maintained.

After that, when the user releases the fingers from the operation cover part 30 of the slider 1, one of the right and left guiding coil springs 7 for guide housed in the base part 20 biases the guide projecting part 36 of the operation cover part 30, and moves the guide projecting part 36 to the guide recessed groove 23 of the base part 20. Accordingly, the operation cover part 30 can be automatically rotated to the above-described reference position. Further, the guide projecting part 36 of the operation cover part 30 is housed in the guide recessed groove 23 of the base part 20 and the operation cover part 30 is held in the reference position. Therefore, the slider 1 can be in the locked state since the projecting part 34*c* for lock of the pressing projecting part 34 is disposed immediately above the stop tab body 40 as illustrated in FIG. 9.

As described above, in the slider 1 of Example 1, when the operation cover part 30 is in the non-operation state in which the operation cover part 30 is not operated, since the operation cover part 30 is held so as not to rotate from the reference position, the slider 1 can be maintained in the locked state. By rotating the operation cover part 30 from the reference position, the slider 1 can be easily switched from the locked state to the unlocked state, whereby the slider 1 can be smoothly slid along the element row. Further, after the sliding operation of the slider 1, the user only releases the fingers from the operation cover part 30, and then the switching to the locked state of the slider 1 can be automatically performed.

As described above, in the slider 1 of Example 1, the locked state and the unlocked state can be easily and smoothly switched by the rotation of the operation cover part 30 as described above, and the automatic stop mechanism that can automatically perform the switching to the locked state with a relatively small number of components or a relatively simple structure can be provided. As a result, since the slider 1 of the invention can be easily manufactured by the simple assembly work as described above, the manufacturing cost can be reduced and the productivity can be improved.

Example 2

Figure 10:
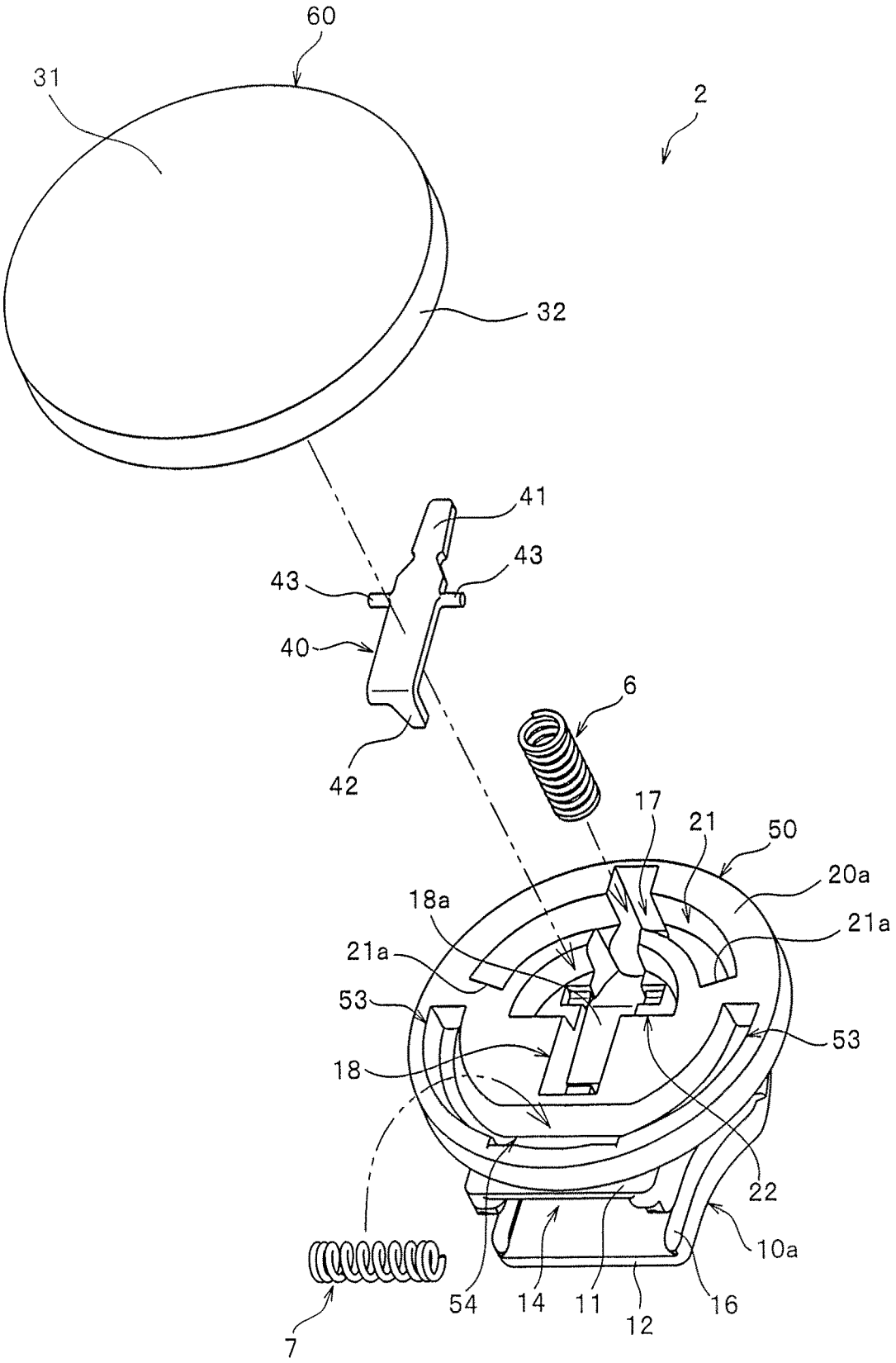
FIG. 10 is an exploded perspective view schematically illustrating a state in which a slider according to Example 2 of the invention is disassembled.
Figure 11:
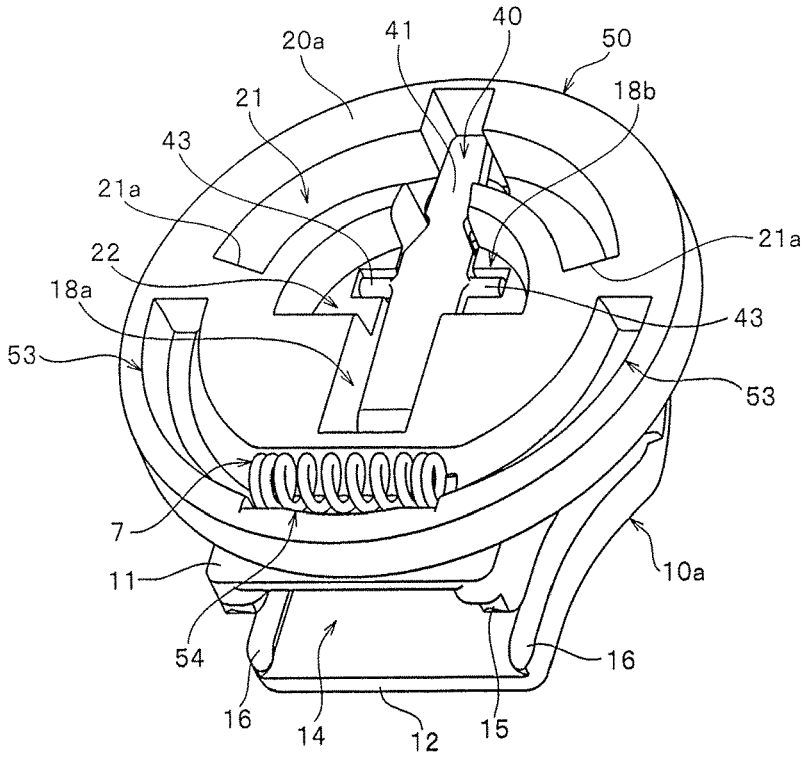
FIG. 11 is a perspective view schematically illustrating a state before an operation cover part is attached in a slider of Example 2.
Figure 12:
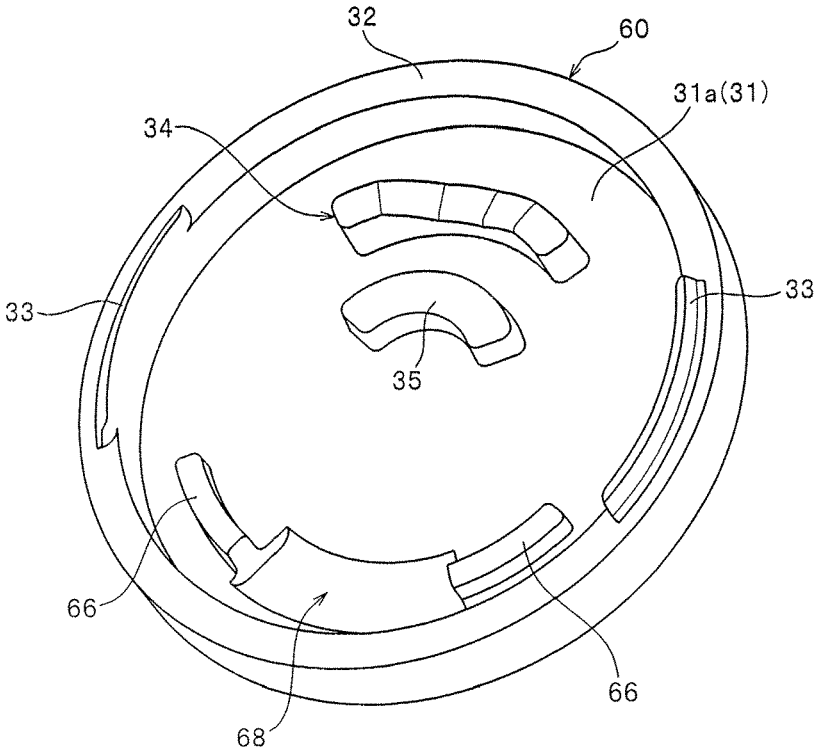
FIG. 12 is a perspective view of an operation cover part of Example 2 when seen from an inner surface side of the operation cover part.

FIG. 10 is an exploded perspective view of the slider according to Example 2. FIG. 11 is a perspective view schematically illustrating a state before an operation cover part is attached. FIG. 12 is a perspective view of the operation cover part when seen from an inner surface side of the operation cover part.

A slider 2 of Example 2 has a mechanism for holding an operation cover part 60 in a reference position and returning the rotated operation cover part 60 to the reference position as a form different from that of the slider 1 of the above-described Example 1. However, in the slider 2 of Example 2, the form other than a portion forming the mechanism is formed substantially in the same manner as the slider 1 of Example 1 described above. Therefore, in Example 2, the portion different from the slider 1 of the above-described Example 1 will be mainly described. Portions having substantially the same form or configuration as the slider 1 of Example 1 will be denoted by the same reference numerals as in Example 1 and will not be described.

The slider 2 of Example 2 includes a slider body part 10*a*, a stop tab body 40, one coil spring 6 for a tab and one guiding coil spring 7 held in a predetermined position of the slider body part 10*a*, and the operation cover part 60. The slider body part 10*a* includes a disk-shaped base part 50 formed integrally with an upper wing plate 11, and in a rear half part of the base part 50, one spring housing part 54 housing a guiding coil spring 7 for guide, and a pair of right and left arc-shaped guide recessed grooves 53 connected to the spring housing part 54 are provided.

The spring housing part 54 of Example 2 is formed in a central region in a width direction in a rear end part of the base part 50 so as to have a rectangular shape in a plan view of the slider body part 10*a*. The right and left guide recessed grooves 53 extend in a peripheral direction of the base part 50 from opposite end parts of the spring housing part 54, and are formed in an arc shape centered on a rotation axis of the operation cover part 60. When the operation cover part 60 is attached to the base part 50 in the reference position, guide projecting parts 66 of the operation cover part 60 can be inserted and housed in the right and left guide recessed grooves 53 respectively.

In Example 2, in the rear half part of the operation cover part 60, an avoidance recessed part 68 disposed in a center part in the width direction and preventing the operation cover part 60 from coming into contact with the guiding coil spring 7, and a pair of right and left guide projecting parts (first guide projecting part and second guide projecting part) 66 disposed in right and left end sides of the avoidance recessed part 68 and projecting from an inner surface 31*a* of a top plate part 31 are provided. In this case, the avoidance recessed part 68 and the right and left guide projecting parts 66 are formed in an arc shape centered on the rotation axis of the operation cover part 60.

In the slider 2 of Example 2 having the slider body part 10*a* and the operation cover part 60 as described above, in a case of a non-operation state in which the operation cover part 60 is not operated, a pair of the right and left guide projecting parts 66 of the operation cover part 60 are housed in the right and left guide recessed grooves 53 of the base part 50 respectively, and the right and left guide projecting parts 66 are held such that one guiding coil spring 7 housed in the center part in the width direction is interposed between the guide projecting parts 66 and comes into contact with the guide projecting parts 66. Accordingly, it is possible to prevent the right and left guide projecting parts 66 of the operation cover part 60 from freely moving in the guide recessed grooves 53 of the base part 50 and freely advancing into the central spring housing part 54. Accordingly, since the operation cover part 60 is stably held in the reference position, the locked state of the slider 2 can be maintained.

A user holds the operation cover part 60 of the slider 2 with fingers and rotates the operation cover part 60 from the reference position either in a clockwise direction or in a counterclockwise direction in a plan view of the slider 2, whereby one of the right and left guide projecting parts 66 can be made to advance into the central spring housing part 54 against a biasing force of the guiding coil spring 7, and a front end part of a substrate part 41 of a stop tab body 40 is pressed down by a pressing projecting part 34. Accordingly, the slider 2 can be easily switched from the locked state to the unlocked state. After that, the slider 2 can be automatically switched to the locked state by the user releasing the fingers from the operation cover part 60.

Therefore, the slider 2 of Example 2 can obtain the same effect as that of the slider 1 of Example 1 described above.

Example 3

Figure 13:
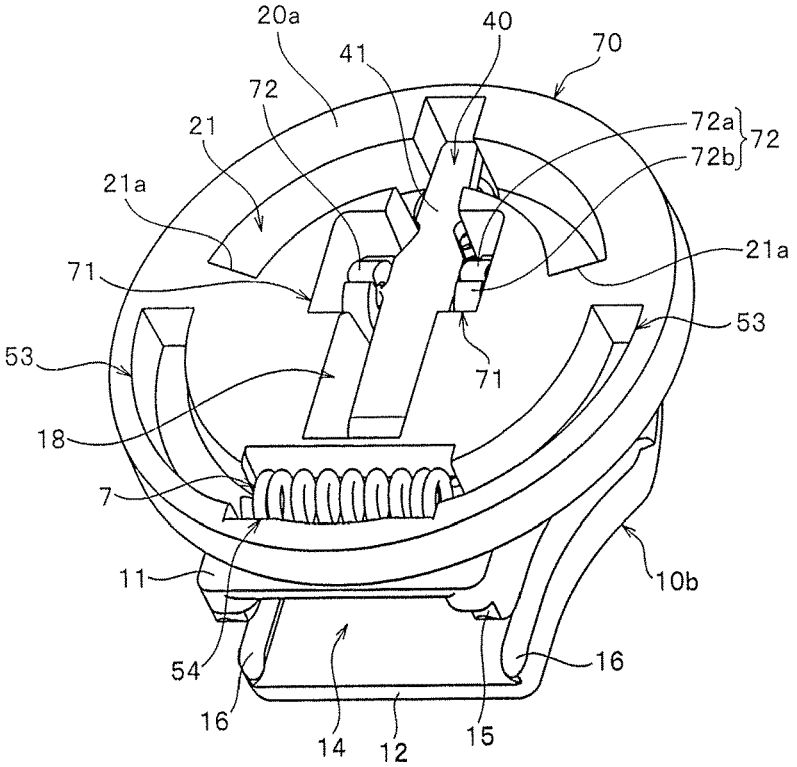
FIG. 13 is a perspective view schematically illustrating a state before an operation cover part is attached in a slider according to Example 3 of the invention.
Figure 14:
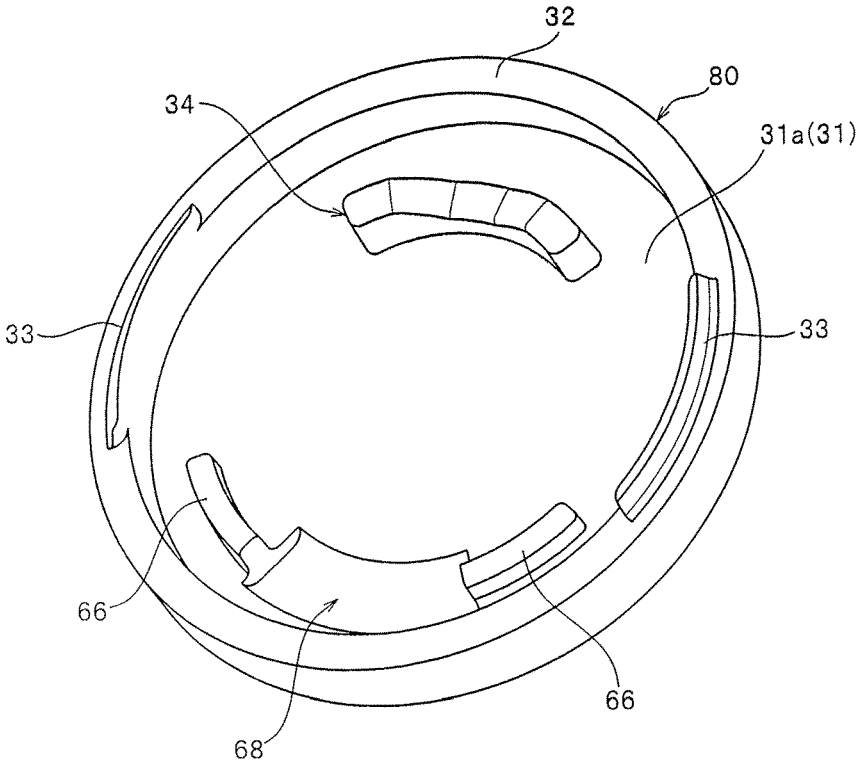
FIG. 14 is a perspective view of an operation cover part of Example 3 when seen from an inner surface side of the operation cover part.

FIG. 13 is a perspective view schematically illustrating a state before an operation cover part of a slider according to Example 3 is attached. FIG. 14 is a perspective view of the operation cover part when seen from an inner surface side of the operation cover part.

A slider 3 of Example 3 has a structure for swingably holding a stop tab body 40 in a slider body part 10*b*, which is different from the structure of the slider 2 of the above-described Example 2, but in the slider 3 of Example 3, a form other than the structure of holding the stop tab body 40 is formed substantially in the same manner as the slider 2 of the above-described Example 2.

The slider 3 of Example 3 includes a slider body part 10*b*, a stop tab body 40, one coil spring 6 for a tab and one guiding coil spring 7 held in a predetermined position of the slider body part 10*b*, and an operation cover part 80. The slider body part 10*b* includes a disk-shaped base part 70 integrally formed with an upper wing plate 11.

The base part 70 of Example 3 includes an arc-shaped housing recessed groove 21, a spring housing part 54 housing a guiding coil spring 7, and a pair of right and left arc-shaped guide recessed grooves 53 connected to the spring housing part 54. However, the semicircular central housing recessed part 22 recessed in the base parts 20 and 50 of Examples 1 and 2 described above is not formed.

Figure 15:
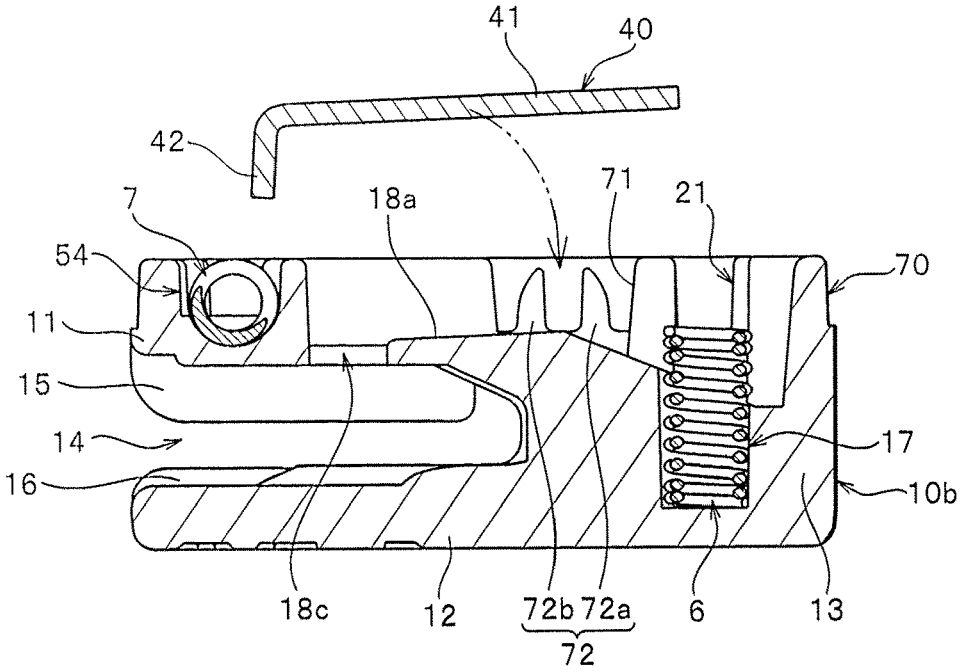
FIG. 15 is an explanatory diagram schematically illustrating attachment of a stop tab body in a slider of Example 3.

In the base part 70, a pair of right and left tab body fixing recessed parts 71, which has a rectangular shape, is provided in right and left sides of the tab body housing recessed part 18 in a plan view of the slider body part 10*b*, and as illustrated in FIG. 15 for example, a tab body holding part 72 that rotatably holds a swing shaft part 43 of the stop tab body 40 is provided in each of the tab body fixing recessed parts 71.

In this case, each of the tab body holding parts 72 includes a pair of front fixing column 72*a* and rear fixing column 72*b* which is raised from a bottom surface of each of the tab body fixing recessed parts 71. The front fixing column 72*a* and the rear fixing column 72*b* are arranged to be separated from each other so as to form a gap between the front fixing column 72*a* and the rear fixing column 72*b*. The swing shaft part 43 of the stop tab body 40 can be inserted into the gap between the front fixing column 72*a* and the rear fixing column 72*b*. The front fixing column 72*a* and the rear fixing column 72*b* have a tapered shape of which a longitudinal dimension gradually decrease upward, and also are plane symmetrical with each other.

The operation cover part 80 of Example 3 is formed in a shape in which the projecting part 35 for a tab is removed from the operation cover part 60 of Example 2 described above. That is, the operation cover part 80 is formed in the same manner as the operation cover part 60 of Example 2 except that the projecting part 35 for a tab is removed.

Figure 16:
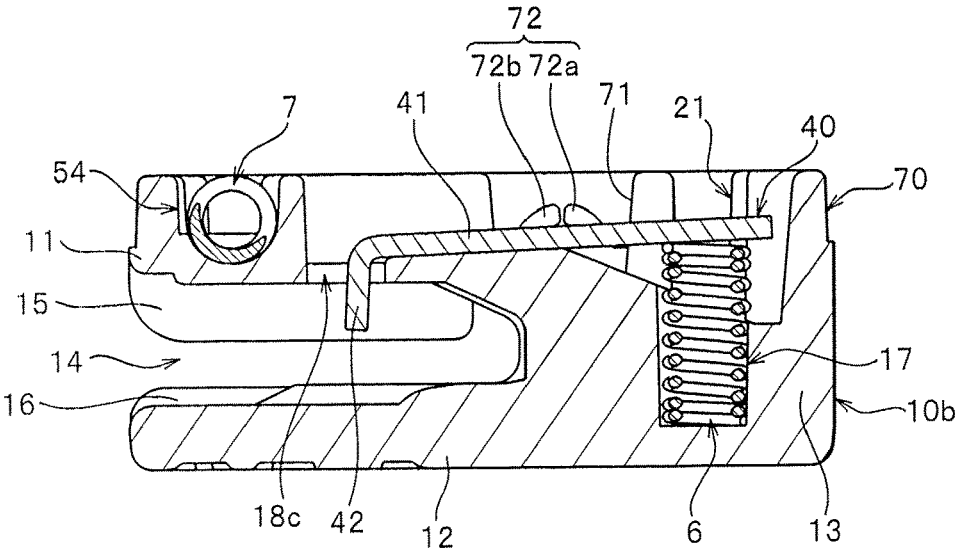
FIG. 16 is a cross-sectional view schematically illustrating a cross section orthogonal to a width direction of a slider of Example 3.

As illustrated in FIG. 15, in the right and left tab body holding parts 72 provided in the slider body part 10*b* of Example 3, after the swing shaft part 43 of the stop tab body 40 is inserted between the front fixing column 72*a* and the rear fixing column 72*b*, an upper end part of the front fixing column 72*a* and an upper end part of the rear fixing column 72*b* are pressed in a direction in which the front fixing column 72*a* and the rear fixing column 72*b* approaches each other to be plastically deformed, and the upper end part of the front fixing column 72*a* and the upper end part of the rear fixing column 72*b* are made to approach each other or come into contact with each other as illustrated in FIG. 16. Accordingly, the stop tab body 40 can be swingably and stably held in the tab body housing recessed part 18 of the slider body part 10*b*.

The slider 3 of Example 3 as described above can also obtain the same effect as the sliders 1 and 2 of Example 1 and Example 2 described above.

In the sliders 1, 2, and 3 of Example 1 to Example 3, the operation cover parts 30, 60, and 80 are formed of a metal, and the right and left projection parts 33 are provided on the operation cover parts 30, 60, and 80 (refer to FIG. 4, and the like). When the operation cover parts 30, 60, and 80 are rotatably attached to the slider body parts 10, 10*a*, and 10*b*, the right and left projection parts 33 provided on the operation cover parts 30, 60, and 80 are pressed to be plastically deformed into the thin plate-like attaching piece parts 37.

However, in the invention, the operation cover part may be formed of a synthetic resin, and may be formed in a form in which right and left thin plate-like attaching piece parts are provided from the beginning instead of the right and left projection parts. In a case of an operation cover part formed of the synthetic resin, the operation cover part is fitted into the base parts 20, 50, and 70 while the operation cover part is slightly and elastically deformed, and the operation cover part can be rotatably attached to the slider body parts 10, 10*a*, and 10*b* with a snap-engagement.

In the sliders 1, 2 and 3 of Example 1 to Example 3, the operation cover parts 30, 60, and 80 are attached to the base parts 20, 50, and 70 so as to be rotatable both in a clockwise direction and in a counterclockwise direction in a front view of the sliders 1, 2, and 3. However, in the invention, the slider can be formed such that the operation cover part is rotated in only one of the clockwise direction and the counterclockwise direction with respect to the base part in a front view of the slider. In this case, the pressing projecting part provided on a back surface of the top plate part of the operation cover part is formed in a form different from the pressing projecting part 34 including two of the first projecting part 34*a* for release and the second projecting part 34*e* for release, which are formed in Example 1 to Example 3, that is, in a form including one projecting part for release, which holds the unlocked state, one projecting part for lock, of which a projecting dimension from the top plate part is smaller than that of the projecting part for release, and one connecting projecting part which is continuously formed between the projecting part for release and the projecting part for lock. Further, in this case, the housing recessed groove formed in the base part is formed corresponding to the form of the pressing projecting part described above and for example, is formed to extend along a circumferential direction either in the clockwise direction or in the counterclockwise direction from a position in which at least a part of the housing recessed groove overlaps with the stop tab body.

Further, in the sliders 1, 2 and 3 of Example 1 to Example 3, at least one of the spring housing parts 24 and 54 is provided in the base parts 20, 50, and 70 of the slider body parts 10, 10*a*, and 10*b* to house the guiding coil spring 7, at least one of the guide recessed grooves 23 and 53 connected to the spring housing parts 24 and 54 is provided, and a mechanism for holding the operation cover parts 30, 60, and 80 in the reference position and returning the rotated operation cover parts 30, 60, and 80 to the reference position is formed in the inner surface 31*a* of the top plate part 31 of the operation cover parts 30, 60, and 80 by providing at least one of the guide projecting parts 36 and 66 housed in the guide recessed grooves 23 and 53.

However, in the invention, when the switching between the locked state and the unlocked state can be performed by rotating the operation cover part, the slider can be formed without providing a mechanism for holding the operation cover part in the reference position and returning the operation cover part (that is, without providing the guiding coil spring, which is housed in the base part of the slider body part, the guide projecting part of the operation cover part, and the like).

REFERENCE SIGNS LIST

1, 2, 3 slider
6 coil spring for tab (tab elastic member)
7 guiding coil spring (guiding elastic member)
10 slider body part
10*a*, 10*b* slider body part
11 upper wing plate
12 lower wing plate
13 connection column
14 element guide path
15 flange part
16 rib part
17 bottomed housing hole
18 tab body housing recessed part
18*a* body housing recessed part

18*b* shaft housing recessed part
18*c* tab hole part
20 base part
20*a* upper surface
20*b* sliding contact part (sliding contact recessed part)
21 housing recessed groove
21*a* side end surface (regulating end surface)
22 central housing recessed part
23 guide recessed groove
24 spring housing part
30 operation cover part
31 top plate part
31*a* inner surface (lower surface)
32 sliding contact wall
33 projection part
34 pressing projecting part
34*a* first projecting part for release
34*b* first connecting projecting part
34*c* projecting part for lock
34*d* second connecting projecting part
34*e* second projecting part for release
35 projecting part for tab
36 guide projecting part
37 attaching piece part
38 avoidance recessed part
40 stop tab body
41 substrate part
42 tab part
43 swing shaft part
50 base part
53 guide recessed groove
54 spring housing part
60 operation cover part
66 guide projecting part
68 avoidance recessed part
70 base part
71 tab body fixing recessed part
72 tab body holding part
72*a* front fixing column
72*b* rear fixing column
80 operation cover part

The invention claimed is:

1. A slider for a slide fastener, the slider comprising:

a slider body part including an upper wing plate, a lower wing plate that forms an element guide path with the upper wing plate, and a connection column that connects the upper wing plate with the lower wing plate;

a stop tab body that is swingably held in the slider body part; and a tab elastic member that projects a part of the stop tab body into the element guide path by biasing the stop tab body, wherein a base part formed integrally on the upper wing plate and an operation cover part rotatably attached to the base part are disposed;

the operation cover part includes a top plate part disposed opposite to an upper surface of the base part, and a pressing projecting part that projects from an inner surface of the top plate part and presses the stop tab body against a biasing force of the tab elastic member;

the pressing projecting part has a structure in which by rotating the operation cover part, a locked state in which a part of the stop tab body is projected into the element guide path by biasing the stop tab body and an unlocked state in which the stop tab body is pressed by the pressing projecting part, whereby a part of the stop tab body is retreated from the element guide path can be switched therebetween;

the pressing projecting part is formed in an arc shape centered on a rotation axis of the operation cover part in a bottom surface view of the operation cover part;

the base part includes a housing recessed groove that is formed in an arc shape in a plan view of the base part and houses the pressing projecting part;

the stop tab body is disposed to overlap with at least a part of the housing recessed groove; and the pressing projecting part includes a projecting part for release, which presses the stop tab body and holds the unlocked state.

2. The slider according to claim 1, wherein the pressing projecting part includes a projecting part for lock, of which a projecting dimension from the top plate part is smaller than that of the projecting part for release.

3. The slider according to claim 2, wherein the pressing projecting part includes a connecting projecting part that is continuously formed between the projecting part for release and the projecting part for lock; and a top end surface of the connecting projecting part is formed as an inclined surface smoothly inclined from the projecting part for release toward the projecting part for lock.

4. The slider according to claim 3, wherein the projecting part for release includes a first projecting part for release and a second projecting part for release, which are disposed in opposite ends of the pressing projecting part having an arc shape respectively;

the projecting part for lock is disposed in a center part of the pressing projecting part having an arc shape; and the connecting projecting part includes a first connecting projecting part formed between the first projecting part for release and the projecting part for lock, and a second connecting projecting part formed between the second projecting part for release and the projecting part for lock.

5. The slider according to claim 2, wherein the housing recessed groove of the base part includes a regulating end surface that regulates a rotation of the operation cover part at a predetermined rotation angle of 90° or less each in a clockwise direction and in a counterclockwise direction from a reference position in which the slider is in the locked state.

6. The slider according to claim 1, wherein the operation cover part includes at least one guide projecting part that projects from an inner surface of the top plate part, and is formed in an arc shape centered on a rotation axis of the operation cover part in a bottom surface view of the operation cover part;

the base part includes a guide recessed groove that is formed in an arc shape in a plan view of the base part and houses the guide projecting part, and at least one spring housing part connected to the guide recessed groove;

at least one guiding elastic member, which biases the guide projecting part, is housed in the spring housing part; and the guide projecting part of the operation cover part is held in the guide recessed groove when the operation cover part is in a reference position in which the slider is in the locked state, and advances into the spring housing part to be disposed in a position in which the guide projecting part is biased by the guiding elastic member when the operation cover part is rotated from the reference position.

7. The slider according to claim 6, wherein the guide projecting part includes a pair of first and second guide projecting parts, which has shapes symmetric to each other and is disposed in positions symmetric to each other in a bottom surface view of the operation cover part; and one guiding elastic member is disposed in a center part of the slider in a width direction, and biases the first or second guide projecting parts when the operation cover part is rotated from the reference position.

8. The slider according to claim 6, wherein the guiding elastic member includes a pair of first and second guiding elastic members, which is housed in positions symmetric to each other, of the base part in a plan view of the base part; and the one guide projecting part is disposed in a center part of the slider in a width direction and is biased by the first or second guiding elastic members when the operation cover part is rotated from the reference position.

9. The slider according to claim 1, wherein the base part includes a tab body housing recessed part that houses the stop tab body;

the operation cover part includes a projecting part for a tab, which projects from an inner surface of the top plate part and presses a part of the stop tab body housed in the tab body housing recessed part; and the projecting part for a tab is formed inside from the pressing projecting part and formed in an arc shape centered on a rotation axis of the operation cover part in a bottom surface view of the operation cover part.

10. The slider according to claim 1, wherein the base part includes a tab body housing recessed part that houses the stop tab body, and a pair of tab body holding parts that rotatably holds a swing shaft part of the stop tab body.

* * * * *